US008651931B2

(12) United States Patent
Brien

(10) Patent No.: US 8,651,931 B2
(45) Date of Patent: Feb. 18, 2014

(54) VIDEO POKER SYSTEM AND METHOD

(76) Inventor: David R Brien, Hidden Hills, CA (US)

( * ) Notice: Subject to any disclaimer, the term of this patent is extended or adjusted under 35 U.S.C. 154(b) by 0 days.

(21) Appl. No.: 13/607,939

(22) Filed: Sep. 10, 2012

(65) Prior Publication Data

US 2013/0072275 A1 Mar. 21, 2013

Related U.S. Application Data

(60) Provisional application No. 61/535,431, filed on Sep. 16, 2011.

(51) Int. Cl.
*G07F 17/32* (2006.01)

(52) U.S. Cl.
USPC ..... 463/13; 273/292

(58) Field of Classification Search
USPC ..... 463/13; 273/292
See application file for complete search history.

(56) References Cited

U.S. PATENT DOCUMENTS

| | | | |
|---|---|---|---|
| 5,732,950 | A | 3/1998 | Moody |
| 5,823,873 | A | 10/1998 | Moody |
| 5,954,335 | A | 9/1999 | Moody |
| 5,976,016 | A | 11/1999 | Moody |
| 6,007,066 | A | 12/1999 | Moody |
| 6,098,985 | A | 8/2000 | Moody |
| 6,120,378 | A | 9/2000 | Moody |
| 6,311,978 | B1 | 11/2001 | Moody |
| 6,315,291 | B1 | 11/2001 | Moody |
| 6,364,313 | B1 | 4/2002 | Moody |
| 6,419,578 | B1 | 7/2002 | Moody |
| 6,517,074 | B1 | 2/2003 | Moody |
| 6,561,898 | B2 | 5/2003 | Moody |
| 6,568,680 | B1 | 5/2003 | Moody |
| 6,652,377 | B1 | 11/2003 | Moody |
| 6,672,959 | B2 | 1/2004 | Moody |
| 6,955,356 | B2 | 10/2005 | Moody |
| 6,964,418 | B2 | 11/2005 | Moody |
| 7,137,628 | B2 | 11/2006 | Moody |
| 7,156,397 | B2 | 1/2007 | Moody |
| 2001/0023199 | A1 | 9/2001 | Walker et al. |
| 2005/0054409 | A1 * | 3/2005 | Cannon ..... 463/13 |
| 2011/0117980 | A1 | 5/2011 | Parham |
| 2011/0165926 | A1 | 7/2011 | Hall |

* cited by examiner

*Primary Examiner* — Omkar Deodhar
(74) *Attorney, Agent, or Firm* — Watson Rounds; Marc D. Foodman

(57) ABSTRACT

An electronic video poker machine configured to allow play of a defined series of hands of video poker. The electronic video poker machine comprises at least one display device, at least one input device, a memory and at least one computer processor configured to display at least a first hand and at last one subsequent hand of at least three cards. A player is provided a first hand of cards on the display. The player identifies which cards from the hand to hold using the input device. The remaining cards from the hand are discarded and draw cards are dealt to replace the discarded cards. The discarded cards are returned to the deck after the draw, making those discarded cards available for subsequent hands in the defined series of hands.

16 Claims, 25 Drawing Sheets

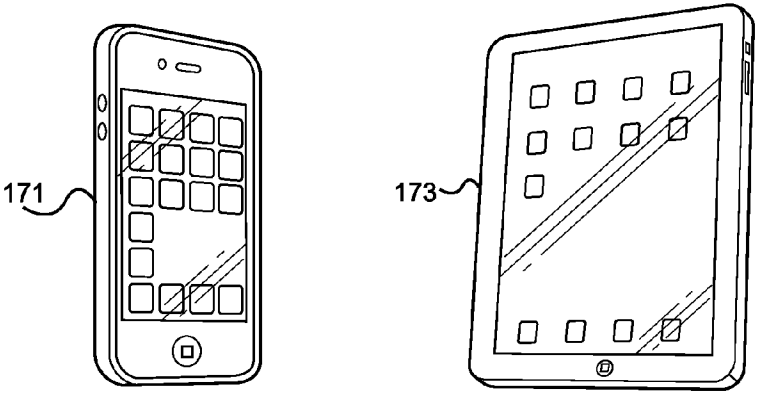
FIG. 1B
PRIOR ART
FIG. 1C
PRIOR ART
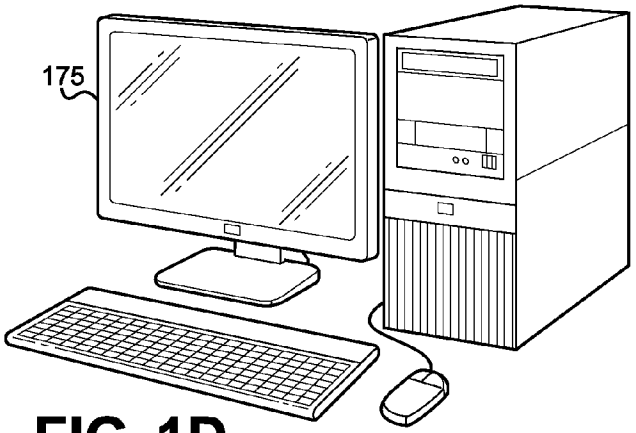
FIG. 1D
PRIOR ART
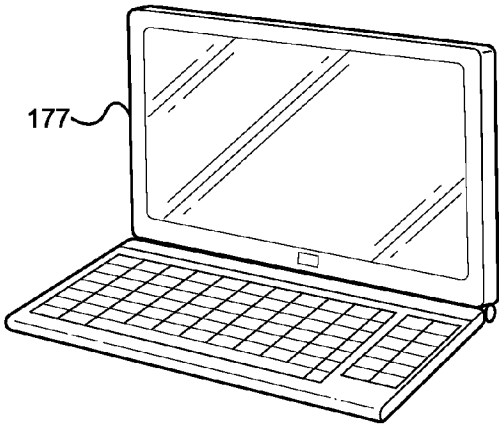
FIG. 1E
PRIOR ART
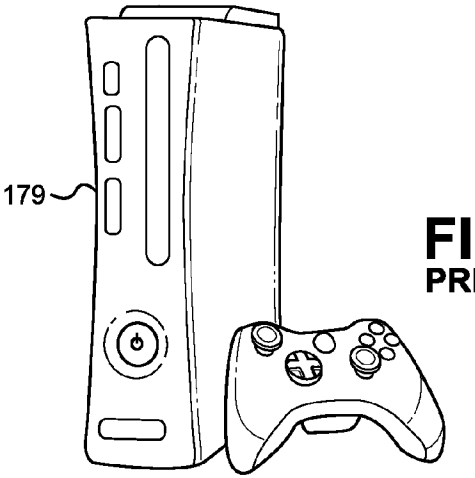
FIG. 1F
PRIOR ART

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND | 25 | 50 | 75 | 100 | 125 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

VIDEO POKER SYSTEM AND METHOD

RELATED APPLICATION INFORMATION

This application claims priority benefit from U.S. Provisional Application No. 61/535,431, filed on Sep. 16, 2011.

COPYRIGHT NOTICE

Portions of this disclosure contain material in which copyright is claimed by the applicant. The applicant has no objection to the copying of this material in the course of making copies of the application file or any patents that may issue on the application, but all other rights whatsoever in the copyrighted material are reserved.

BACKGROUND

The present invention relates generally to electronic gaming machines, and more particularly to a system and method for playing video poker in a session with a series of hands.

Electronic gaming machines ("EGMs") are extremely popular with casino patrons for playing slot games and video poker games. Over the years, video poker games have become extremely popular and provide players with a high level of entertainment. In some forms, video poker implements the use of multi-hands, thereby connecting play of hands through different techniques. Multi-hand play challenges a player to employ optimum play strategy to maximize the number of wins and the value of the wins over multiple hands.

One common feature of video poker games, including multi-hand games, is that each separate poker hand is played from an individual deck with 52 cards. This means that it is difficult for the player to predict with a high probability what cards of those remaining in the deck will be dealt in the initial hand or on the draw. In a typical video poker game, a player is initially dealt five cards. The player can replace any number of the five dealt cards up to and including all five cards. That means that the probability of predicting the draw cards is no better than five out of 47 and that assumes that all five cards dealt on the initial deal are discarded. The probability drops to four in 47, three in 47, two in 47 or one in 47 depending on the number of cards held before the draw. Experienced poker players understand the probabilities and the pay tables associated with their favorite games and seek to employ optimal strategies for obtaining a low frequency, high pay for a hand like a royal flush or four-of-a-kind, or alternatively, a high frequency, low pay for a hand like two face cards.

Accordingly, there is a need for video poker systems and games that provide players with higher predictability of final hands and greater excitement throughout the playing experience. There is also a need to encourage players to play more often or for longer periods while giving the player the opportunity for paybacks that happen with greater frequency or in higher amounts. Further, there is a need for systems and methods that give players the chance to employ a variety of play strategies to make the experience more fun and exciting. These and other features of the system and method disclosed herein will become more readily apparent from the following description.

BRIEF DESCRIPTION OF THE DRAWINGS

For a better understanding of the present invention, and to show more clearly how it functions, reference will now be made, by way of example, to the accompanying drawings. The drawings show embodiments of the present invention in which:

FIGS. 1B-1F show computing devices for playing a game;

DETAILED DESCRIPTION

The following description provides details with reference to the accompanying drawings. It should be understood that the invention may be embodied in many different forms and should not be construed as limited to the embodiments set forth herein. The system and method described herein may be implemented on an electronic gaming machine for use in a casino gaming facility at a stand-alone video poker machine, a live table game or an electronic table game with a live or video dealer. Or, alternatively, the system and method may be implemented in a live game between one or more players playing against a dealer, each other or both.

Figure 1A:
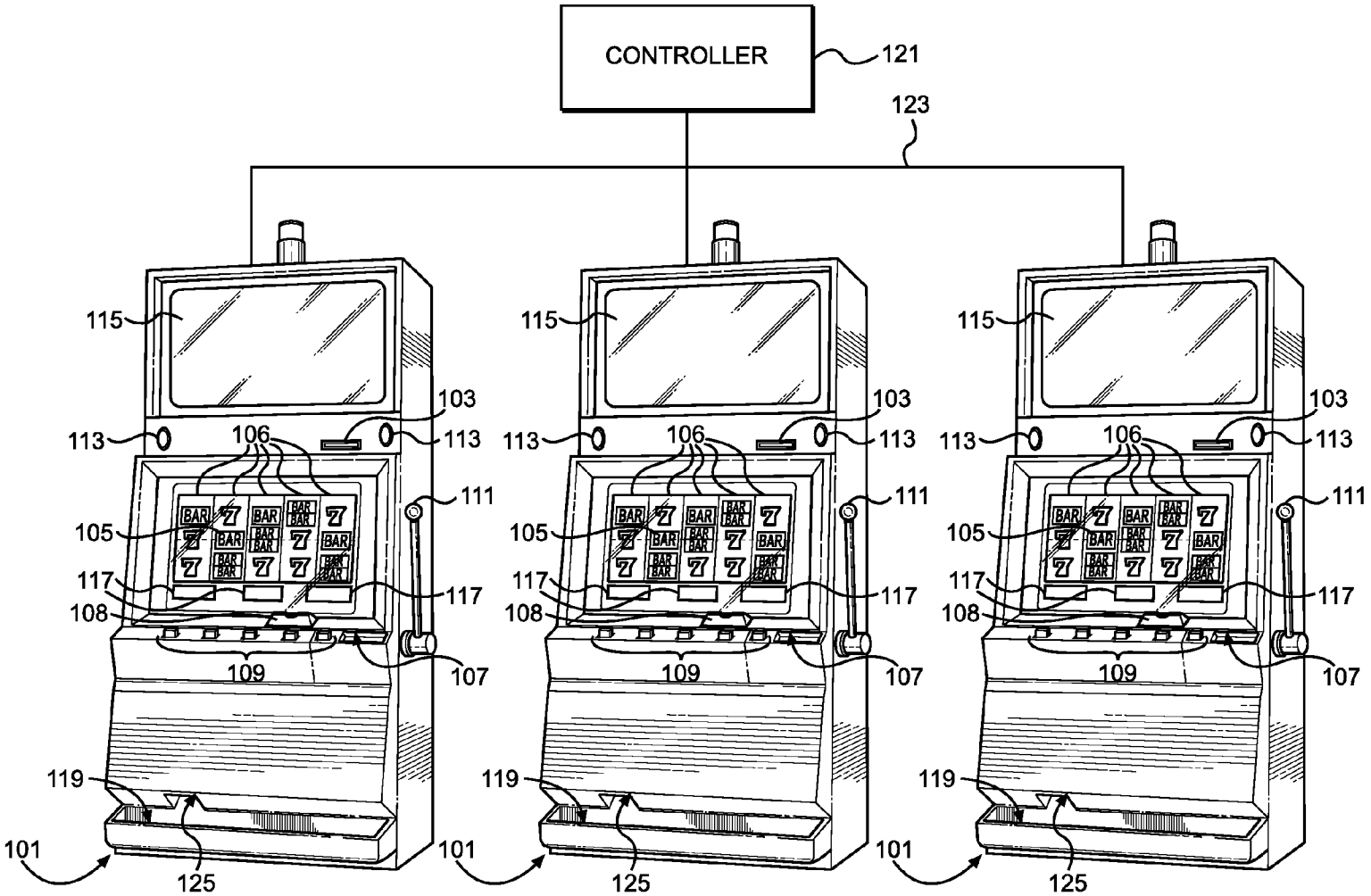
FIG. 1A PRIOR ART
FIG. 1A shows electronic gaming machines for playing a game connected to a network controlled by a server.

FIG. 1A shows a group of electronic gaming machines ("EGM") connected to a central controller. The EGMs pictured are electronic video slot machines, but these machines are also capable of displaying video poker or other types of video games. Each EGM 101 is a wagering device that is used in a casino and may be configured to display and play any of a number of different types of games, including but not limited to electromechanical spinning reel type slot games, video reel games, video poker, keno, roulette, craps, blackjack, or any other type of wagering game.

A group of EGMs 101 forms a bank that may be connected together for different types of system applications. For example, a group of EGMs 101 may be linked together for bonusing in a variety of ways, including progressive bonuses where a portion of an amount wagered is applied to a progressive meter that advances as additional games are played. It is also common for EGMs in a casino establishment to be connected to systems for player tracking so that the casino can keep track of the amount of play by each individual player. In that case, each player is issued a player tracking device such as a card that is inserted into a card slot 103 on EGM 101 during play. The card identifies the player to the system and all wagered amounts are tracked for loyalty rewards and other marketing programs of the casino. Other systems connecting EGMs 101 are used for accounting purposes so that a casino operator can monitor and track play, and assess performance of EGMs across the entire casino floor.

Each EGM 101 has a number of components. A display 105 is used to show game play and resulting outcomes, and may be in the form of a video display (shown), or alternatively, physical reels. Touch screen displays are included on most EGMs and provide a flexible interface for operation of EGM 101, including displaying symbols 106 during play. Other components include a bill validator and a coin acceptor that are both housed inside EGM 101 into which bills may be inserted through bill slot 107 and coins may be inserted through coin head 108, respectively. Buttons 109 on the exterior of EGM 101 are used to control certain EGM operations in conjunction with touch screen display 105. A handle 111 may be used to initiate play of a game and speakers 113 are used to provide sounds in conjunction with game play and other EGM operations. EGMs further include a top box 115 for displaying pay tables, artwork, advertising or other types of information either on fixed glass or on other displays such as an integrated video panel. Top box 115 may be fitted with a liquid crystal display ("LCD") screen to permit aspects of game play from either a base game or a secondary game to be shown in top box 115. Meters 117 for tracking credits available for play and other amounts are positioned near the bottom or screen 105. A coin tray 119 at the bottom of EGM 101 is used to catch coins as they are dispensed to a player. It is also common for EGM 101 to include a ticket-in, ticket-out ("TITO") component that is part of the bill validator housed inside of EGM 101 that may accept bar coded credits through slot 107 and for which the value of the credits is displayed on meters 117 upon a ticket being inserted.

All operational functions of EGM 101 are controlled by a controller such as a microprocessor (not shown) housed in side EGM 101. The controller executes instructions that include operation of a random number generator ("RNG") that is well known to those of ordinary skill in the art. Game outcomes are determined based on the results corresponding to the numbers selected by the RNG.

Figure 2A:
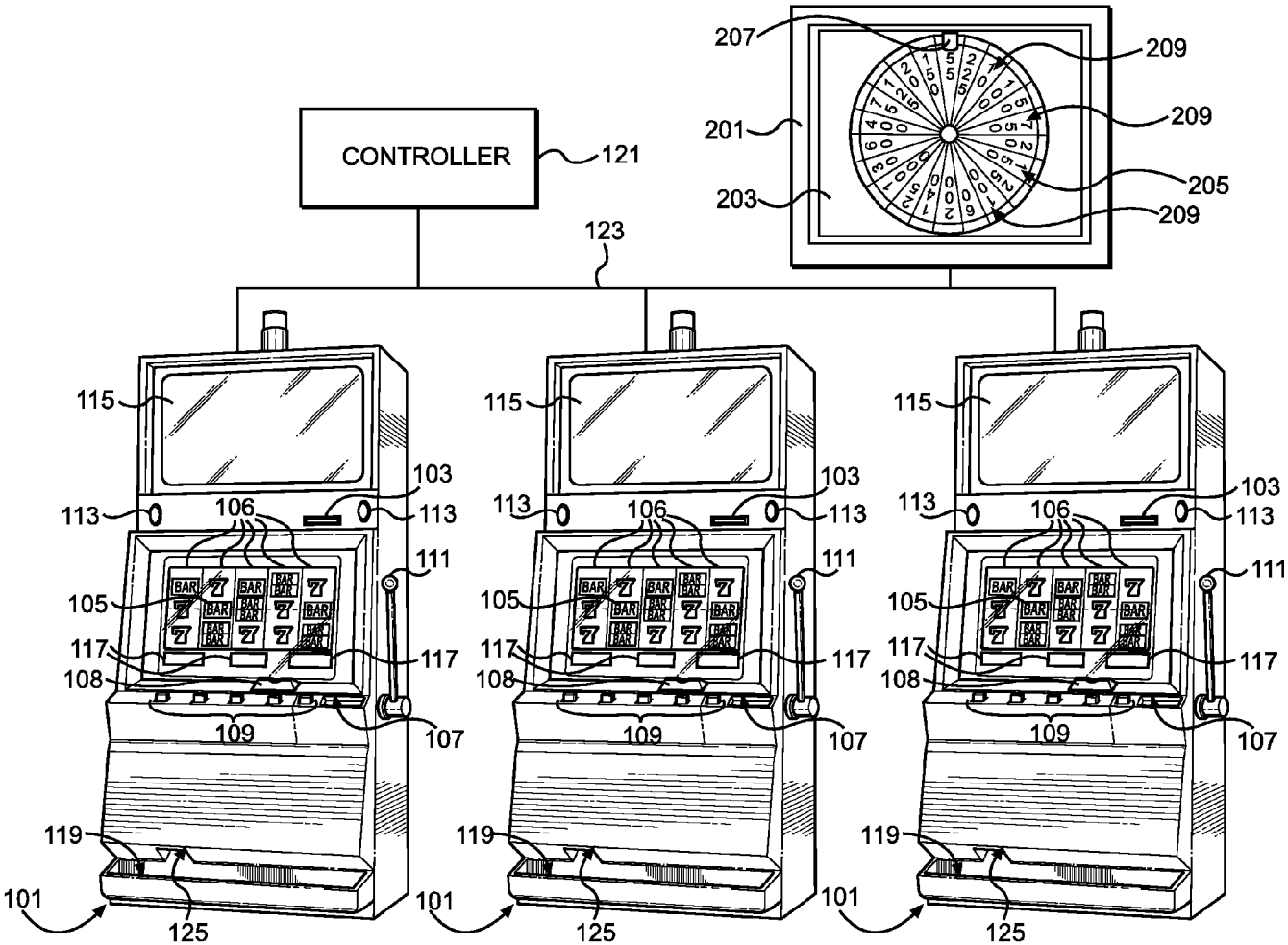
FIG. 2A PRIOR ART
FIG. 2A shows electronic gaming machines for playing a game connected to a network controlled by a server and including a networked bonus game display.

In the system of FIG. 1A, EGMs 101 are connected to a controller 121 that is used to interface with EGMs 101 to perform a number of different functions, depending on how games on EGMs 101 are configured to operate. For example, controller 121 may instruct EGMs 101 to dispense cash bonuses based on winning events on a networked bonus feature such as a bonus wheel 201 as shown in FIG. 2A. Controller 121 is a microprocessor based device such as a computer or server that is in two-way communication with each of the EGMs 101 in a multi-device system over a network connection 123. Controller 121 receives signals from EGM 101 that may indicate any of a number of different types of events occurring on EGM 101.

FIGS. 1B-1F show a number of general purpose computing devices which may be used to play a game. These figures show a smartphone 171 in FIG. 1B which may be an Apple iPhone 4S® as pictured, or any other mobile phone type device. A tablet computer 173 is shown in FIG. 1C which may be an Apple iPad 3® as pictured, or any other tablet computing device. A desktop computer 175 is shown in FIG. 1D which may be a Lenovo® machine as pictured, or any other desktop computer. A laptop computer 177 is shown in FIG. 1E which may be a Lenovo® computer or any other laptop computer. And, a home video gaming device 179 is shown in FIG. 1F which may be a Microsoft Xbox® system or any other home video system. Other types of network connected devices could also be used to play games including portable video gaming devices such as a Sony PSP®, a Nintendo GameBoy®, or an internet connected television with a browser or app capabilities. Any of these devices is capable of playing a game, including a wagering game, through an app loaded onto the device or through a website accessible using a browser on the device. In the case of the networked game, payment may be made by credit card, Paypal® or another payment service. The RNG is run securely on a server based system and then delivers the outcomes over the internet to be displayed on the general purpose computing device.

FIG. 2A shows a group of EGMs 101 and controller 121 connected on network 123 along with a bonus device 201. Bonus device 201 is in the form of a wheel 203 with different potential winning outcome amounts 205 shown on it. Bonus device 201 also includes an indicator 207 to indicate the winning position when wheel 203 comes to a stop. Prize values 209 or other symbols representing different outcomes are shown in the different positions or segments of wheel 203. It should be understood that bonus device 201 may alternatively be a screen for displaying a bonus indicator such as a wheel or any other indicator representation. Further, bonus device 201 may alternatively be incorporated in the housing of EGM 101 such as in top box 115, or it may be a separate device situated nearby to EGM 101 and shared by more than one EGM 101 so that it may be displayed prominently for visitors to a casino establishment to see thereby raising the excitement level for the player playing and the other casino customers. Bonus device 201 may take the form of any bonus indicator, a variety of which are known, including but not limited to reels, "pick a prize" reveal type bonus indicators, timers, arrows, etc. Bonus device 201 may also be in the form of a dedicated device specifically designed for a particular type of bonus, such as a wheel.

In FIG. 2A, EGM 101 is shown as a casino gaming device of the type depicted in FIG. 1A. It should be understood that any one or more of the general purpose computing devices of FIG. 1B-1F—smartphone 171, tablet computer 173, desktop computer 175, laptop computer 177, or home video gaming system 179 shown in FIGS. 1B-1F—could be placed on a network connected to server based system 221 and used to deliver a game as described herein. For purposes of this specification, reference to one or more EGMs 101 in an environment using a limited access intranet of the type typically found in a casino would also apply to one or more general purpose computing devices with a secure connection to a server over the internet and not involving a physical casino property at all, and which may or may not require a wager or payment to play.

Figure 2B:
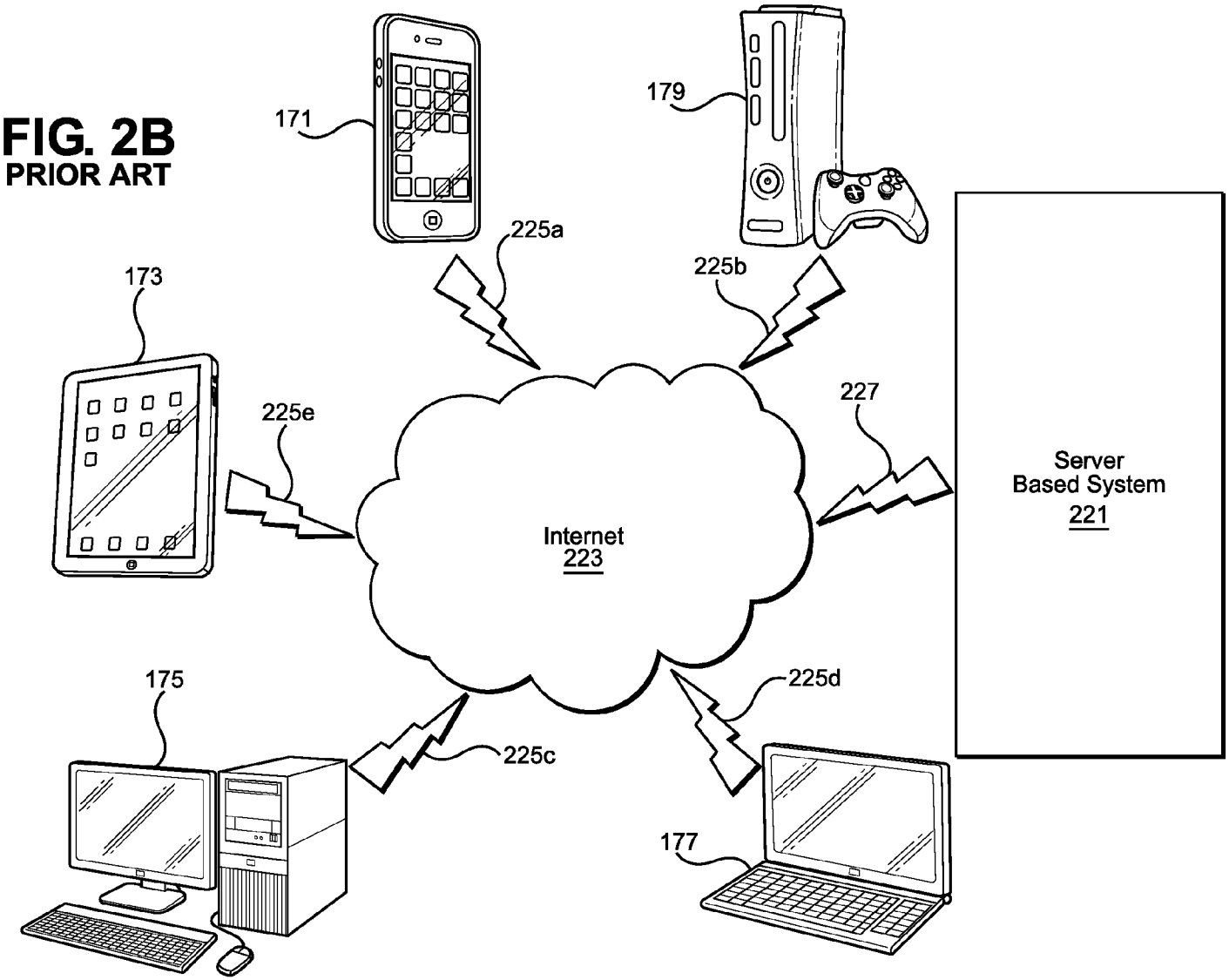
FIG. 2B PRIOR ART
FIG. 2B shows a group of electronic gaming machines on a network connected to a server based system and an external system.

FIG. 2B shows server based system 221 connected to a network with multiple computing devices for playing games. It should be understood that the network shown in FIG. 2B operates in a manner similar to the network of FIG. 2A, except that the computing devices on the network of FIG. 2B are connected over the internet 223 with each device 171-179 connected over a secure connection 225*a-e* to server based system 221 which connects to internet 223 over network connection 227. Payments can be made securely over internet 223 using connections 225*a-e*, and then delivered to an operator over connection 227. Similarly, the game is executed on server based system 221 using a secure RNG with the outcomes being delivered to the individual devices 171-179 over internet 223. Alternatively, the game software or a portion of it may be resident and executed on each device 171-179. Wagers by players and payments to players may be made using accounts set up with an operator of a website on which the games are run.

It will be understood that the type of network over which data is communicated can be one of several different types of networks. These networks include a Local Area Network (LAN), Wide Area Network (WAN), an intranet or the Internet. Other proprietary networks could also be used without departing from the principles of the invention. This would include such networks as a Windows network or an Ethernet network. Throughout FIGS. 1-3, like elements of the invention are referred to by the same reference numerals for consistency purposes.

Figure 3:
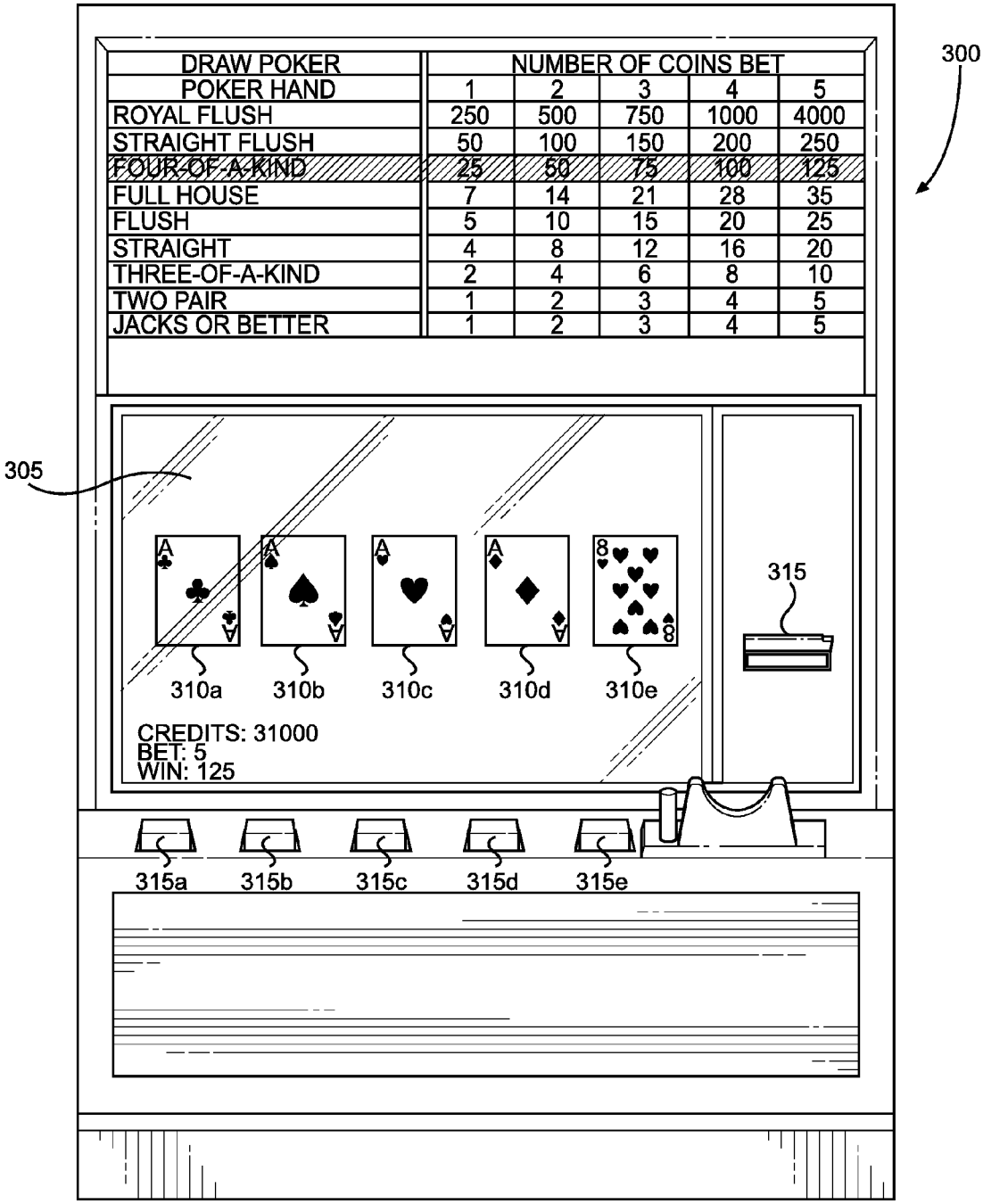
FIG. 3 PRIOR ART
FIG. 3 is an electronic gaming machine for use in the play of video poker.

FIG. 3 shows an electronic video poker gaming machine ("EGM") 300 for playing video poker having a display screen 305 for displaying cards or other symbols at positions 310*a-e*. A set of buttons 315*a-e* corresponding to card display positions 310*a-e* and situated on the cabinet of EGM 300 may be used by a player to provide input to EGM 300. It should be understood that different inputs may also be used. For example, display 305 may be a touch screen and buttons may appear on the screen lined up under card positions 310*a-e* or otherwise proximate to card positions 110*a-e*. A computer processor (not shown) and an internal memory (not shown) that stores an executable game program are among the internal circuit components that allow EGM 300 to operate a video poker game or other type of game. EGM 300 also includes a device 315 for accepting wagers and making payouts to players. Device 315 is typically a note acceptor-dispenser that accepts and validates currency inserted by the player, and for dispensing currency to a player for unused credits that are either unplayed or won during a play session. Device 315 may also configured to print tickets for an amount of credit available to the player when he no longer desires to play the machine. The tickets can be re-inserted into EGM 300 or other EGMs on the casino floor or redeemed for cash by the casino. As generally discussed above with respect to FIG. 1A, the internal components, configurations and operations of an EGM are well known to those of ordinary skill in the art.

The system and method are directed to a session of play measured in two or more hands where cards are dealt from a single deck or multiple decks stored virtually in the memory of EGM 300. In accordance with the embodiment, the deck (or multiple decks) is not reset at the beginning of each subsequent game in the session. For example, a play session may comprise five separate game plays and this detailed description is based on a five play session. It should be understood that a session may be any number of games that is two or more, but an upper limit is reached at the point where there are not enough cards in the deck (or multiple decks) from which to deal any additional cards.

Figure 4A:
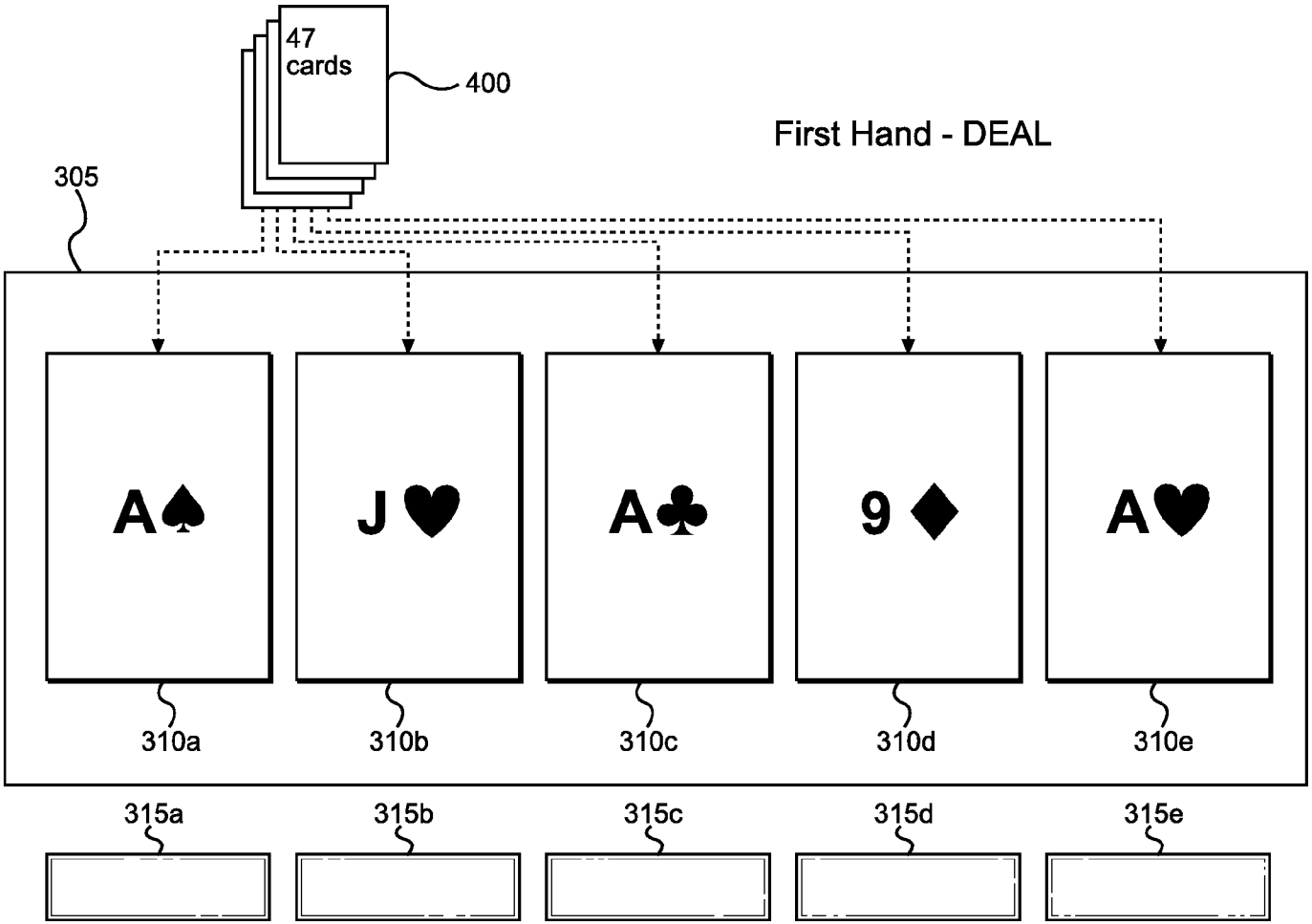
FIGS. 4A-4D are successive screen shots of a video poker machine display with game play screens illustrating the system and method according to an embodiment.

FIG. 4A is a screen shot of display 305 of EGM 300 after a player has initiated game play. As can be seen in FIG. 4A, a set of five cards has been dealt to the player and those cards are shown in positions 310*a-e* on display 305. A virtual deck 400 is shown representing the deck of cards from which the initial cards have been dealt. A card count of 47 cards is shown in deck 400 reflecting that five cards have been dealt in the initial hand of the series of games. Virtual deck 400 is typically a complete set of 52 cards, but may also include wild cards or other special cards depending on the particular game that is being played.

As can be seen in the example shown in FIG. 4A, the initial hand dealt to the player consists of an ace of spades at position 310*a*, a jack of hearts at position 310*b*, an ace of clubs at position 310*c*, a nine of diamonds at position 310*d* and an ace of hearts at position 310*e*. Once the hand is dealt, the player must make a decision as to which cards to hold. Experienced poker players employing optimum poker strategy in this case would hold the three aces at position 310*a*, 310*c* and 310*e*. The player holds the cards by pressing the corresponding buttons 315*a*, 315*c* and 315*e* and then hitting a draw button (not shown) on EGM 300.

Figure 4B:
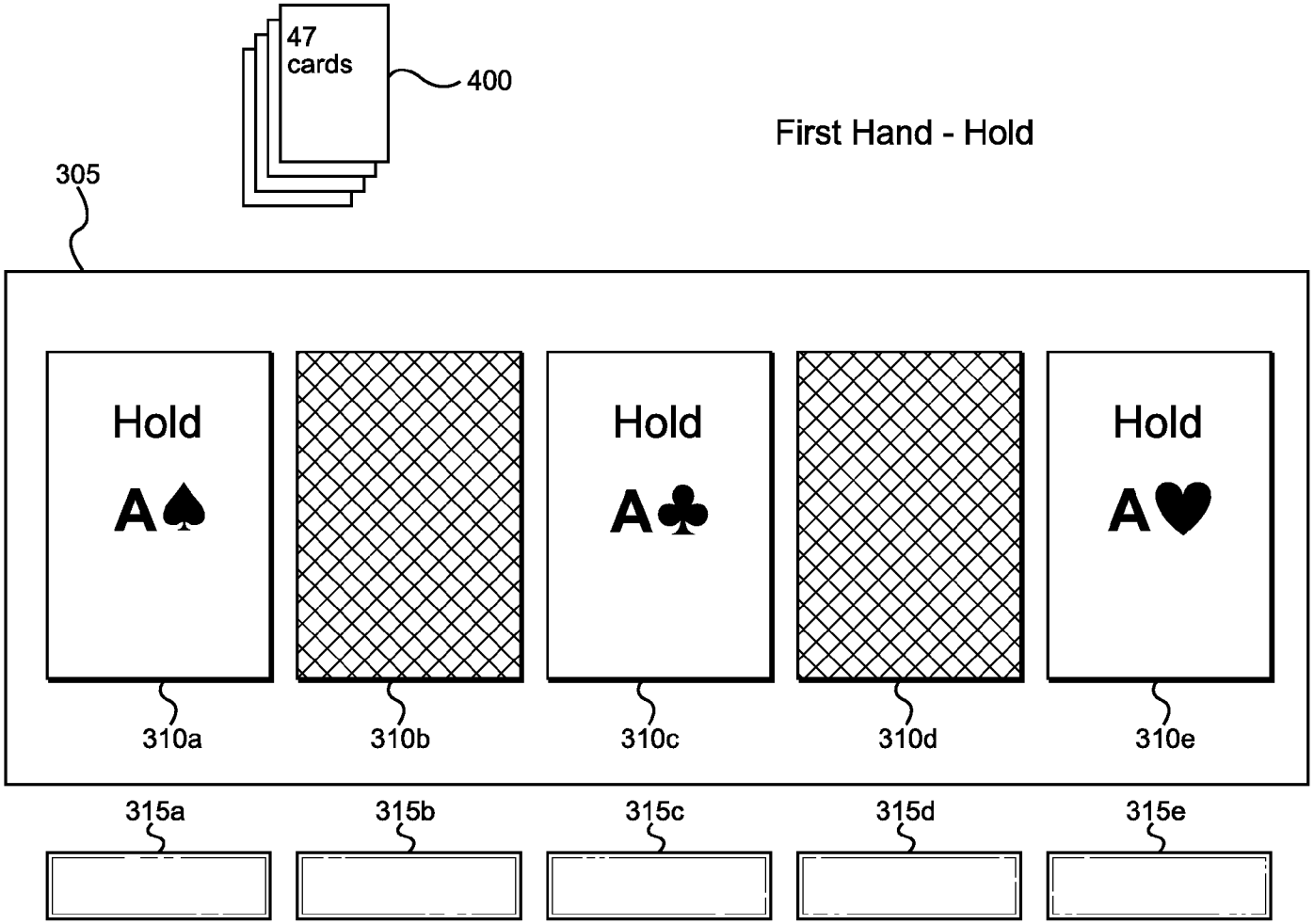

FIG. 4B is a screen shot of display 305 after the player holds the selected cards (indicated by "Hold") and hits the draw button, but before the new cards are dealt to substitute for the cards discarded by the player from the initial hand. The blacked out cards at positions 310*b* and 310*d* represent the discarded cards. The card count in deck 400 remains at 47.

Figure 4C:
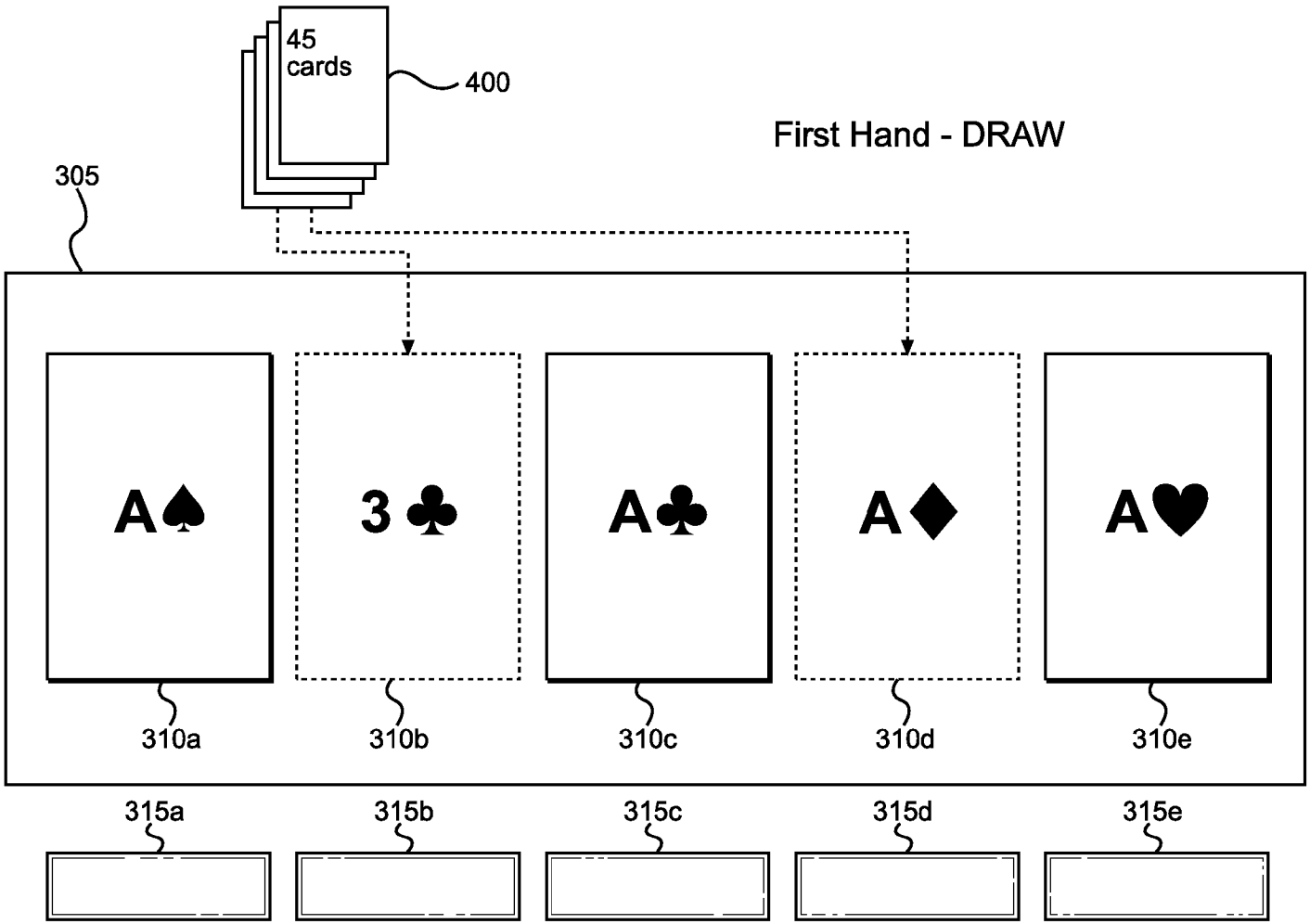

FIG. 4C is a screen shot of display 305 after the draw where new cards are substituted for the discarded cards at positions 310*b* and 310*d* and are shown in dashed line outline form. As can be seen in FIG. 4C, two cards are drawn: the three of clubs has replaced the jack of hearts at position 310*b* and the ace of diamonds has replaced the nine of diamonds at position 310*d*. The resulting hand includes four aces which would customarily provide the player with a large payout. After the draw, the card count in deck 400 drops to 45.

Figure 4D:
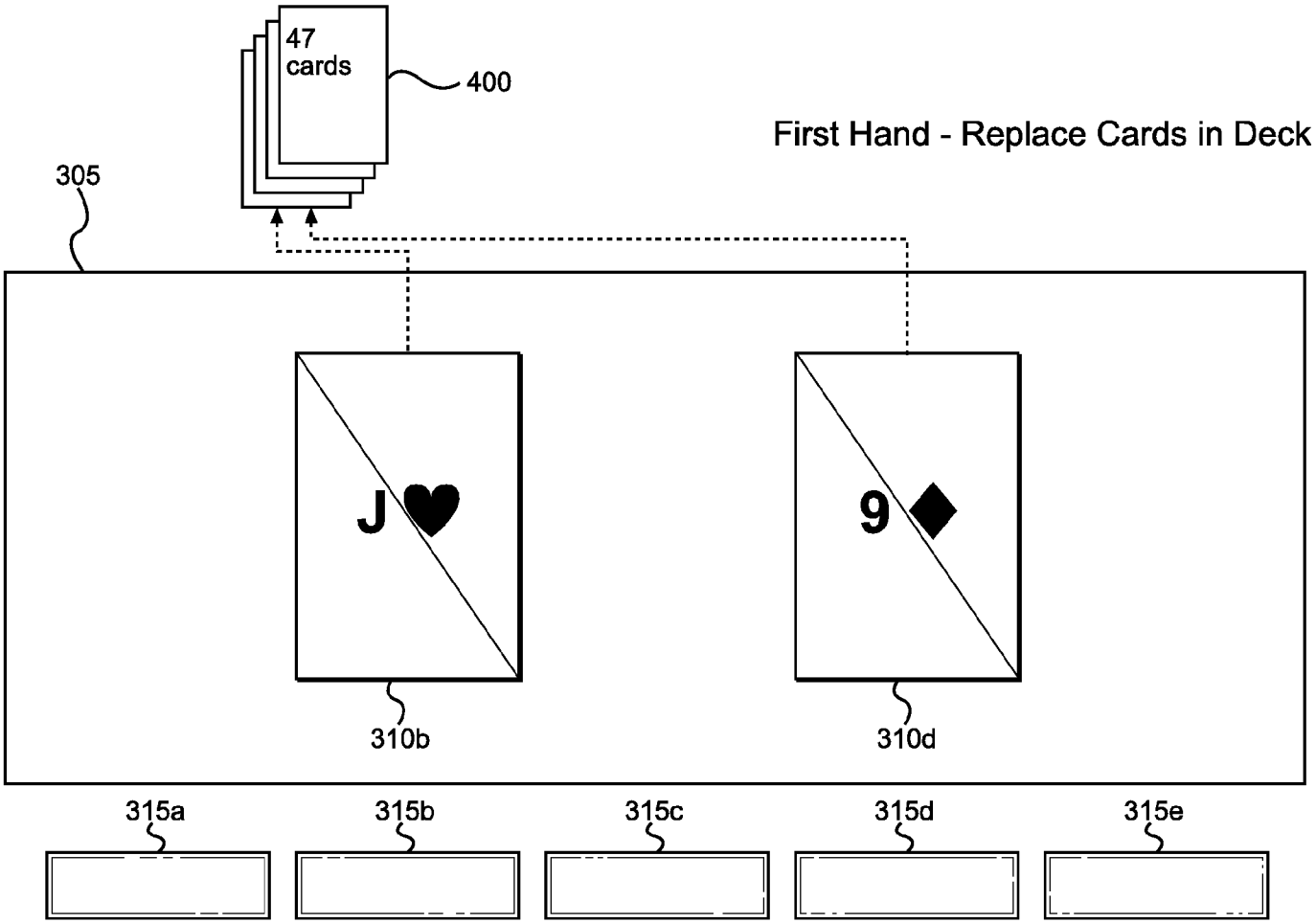

FIG. 4D is a representative screen shot of display 305 showing the discarded cards from the initial hand—jack of hearts and nine of diamonds—being placed back in deck 400 upon completion of the hand so that those cards are now available to be dealt to the player in subsequent hands. For purposes of game play, the screen shot of FIG. 4D may or not be seen by the player during play. FIG. 4D is shown to provide a visual representation of the discarded cards being returned to deck 400. The card count of deck 400 increases to 47 and deck 400 is now ready to be used for a second hand in the series of five games. When play of the second hand begins, the card count of 47 reflects the fact that the four aces and the three of clubs are no longer in deck 400 after they were used to complete the ending hand of the first game.

In accordance with an alternative embodiment, any card not used in a winning combination at the end of the game could be returned to the deck for the next game in the series. In that case, in addition to the jack of hearts and the nine of diamonds, the three of clubs would also be returned to deck 400 for potential replay in subsequent hands. Deck 400 would then have 48 cards at the start of the second hand in the series.

Figure 5A:
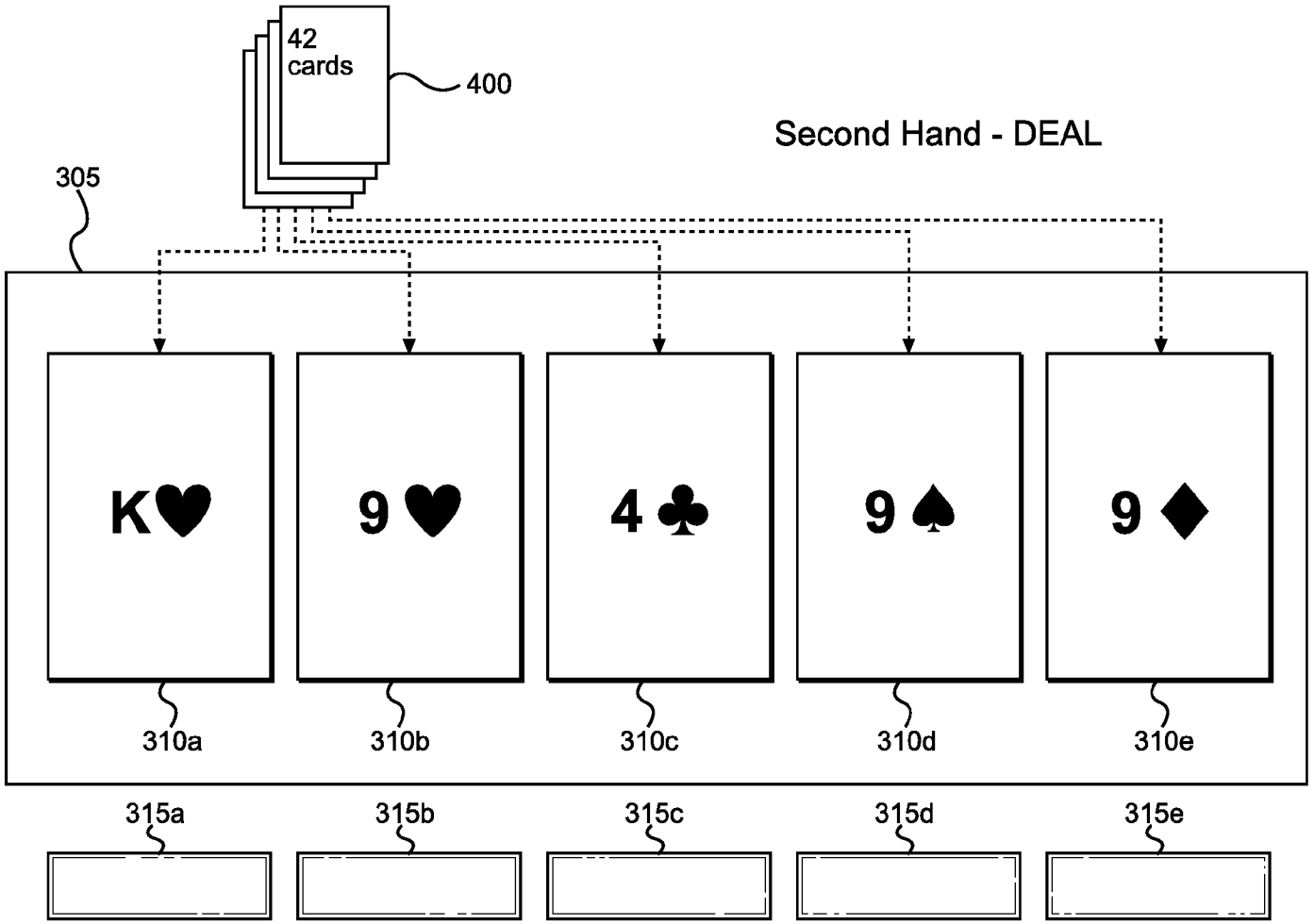
FIGS. 5A-D are successive screen shots of a video poker machine display with game play screens illustrating the system and method according to an embodiment.

FIG. 5A is a screen shot of display 305 of EGM 300 after a player has initiated game play of the second game in the series of five games. As can be seen in FIG. 5A, a set of five cards has been dealt to the player and those cards are shown in positions 310*a-e* on display 305. Virtual deck 400 is shown with a card count of 42 cards reflecting that five cards were used in the first hand that were not returned to deck 400 and another five cards have been dealt in the second hand.

As can be seen in FIG. 5A, the second hand dealt to the player consists of a king of hearts at position 310*a*, a nine of hearts at position 310*b*, a four of clubs at position 310*c*, a nine of spades at position 310*d* and a nine of diamonds at position 310*e*. Once the hand is dealt, the player must make a decision as to which cards to hold. In this example, the nine of diamonds is one of the cards that was discarded from the deal in the first hand and was returned to deck 400. It has been re-dealt to the player in the second hand. With three nines in the second hand, the player is likely to hold the three nines and go for four of a kind, choosing to discard the king of hearts at position 310*a* and the four of clubs at position 310*c*. The player holds the three nines by pressing the corresponding buttons 315*b*, 315*d* and 315*e*.

Figure 5B:
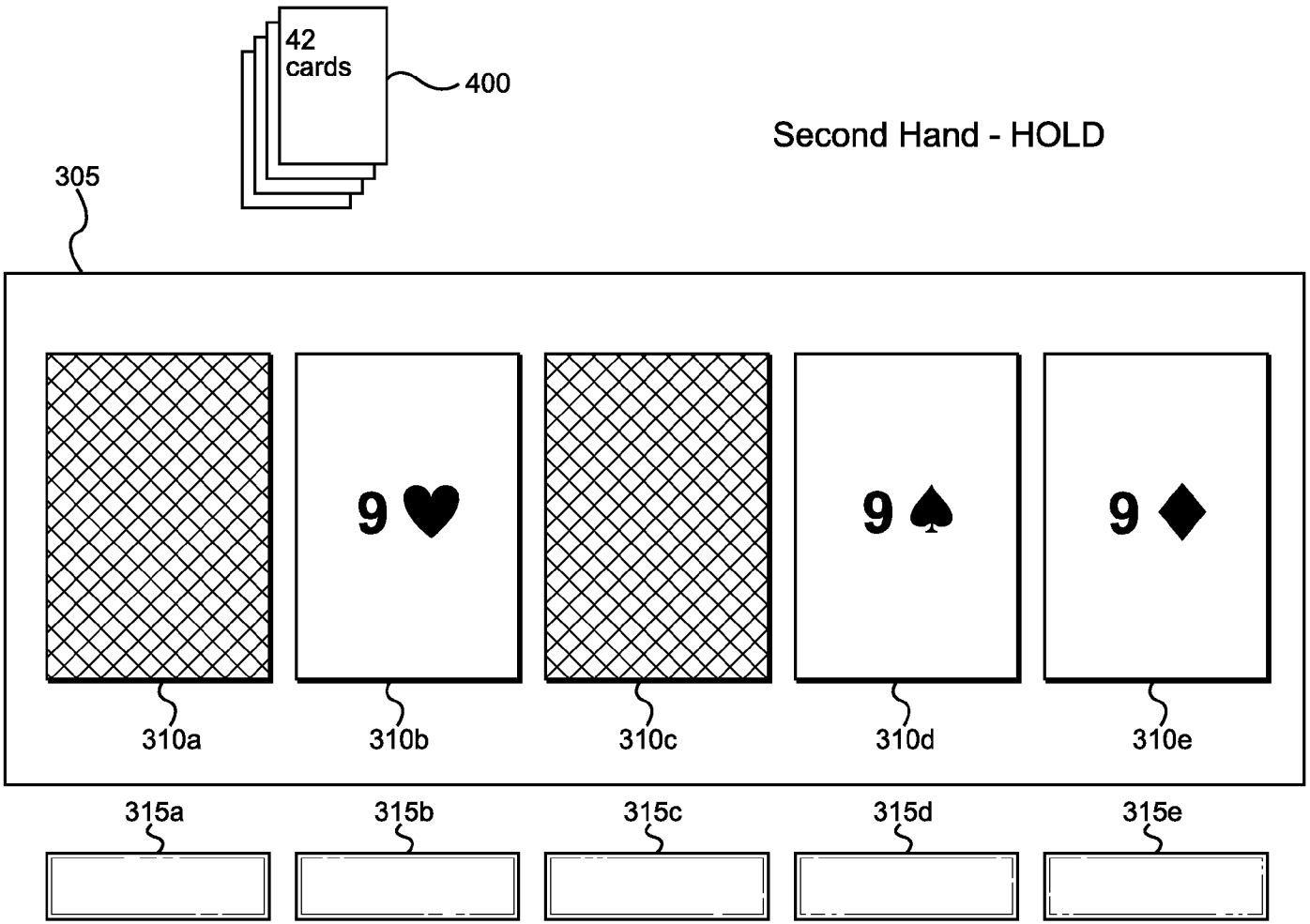

FIG. 5B is a screen shot of display 305 after the player holds the selected cards (indicated by "Hold") and hits the draw button in the second game, but before the new cards are dealt to substitute for the cards discarded by the player from the second hand. The blacked out cards at positions 310*a* and 310*c* represent the discarded cards. The card count in deck 400 remains at 47.

Figure 5C:
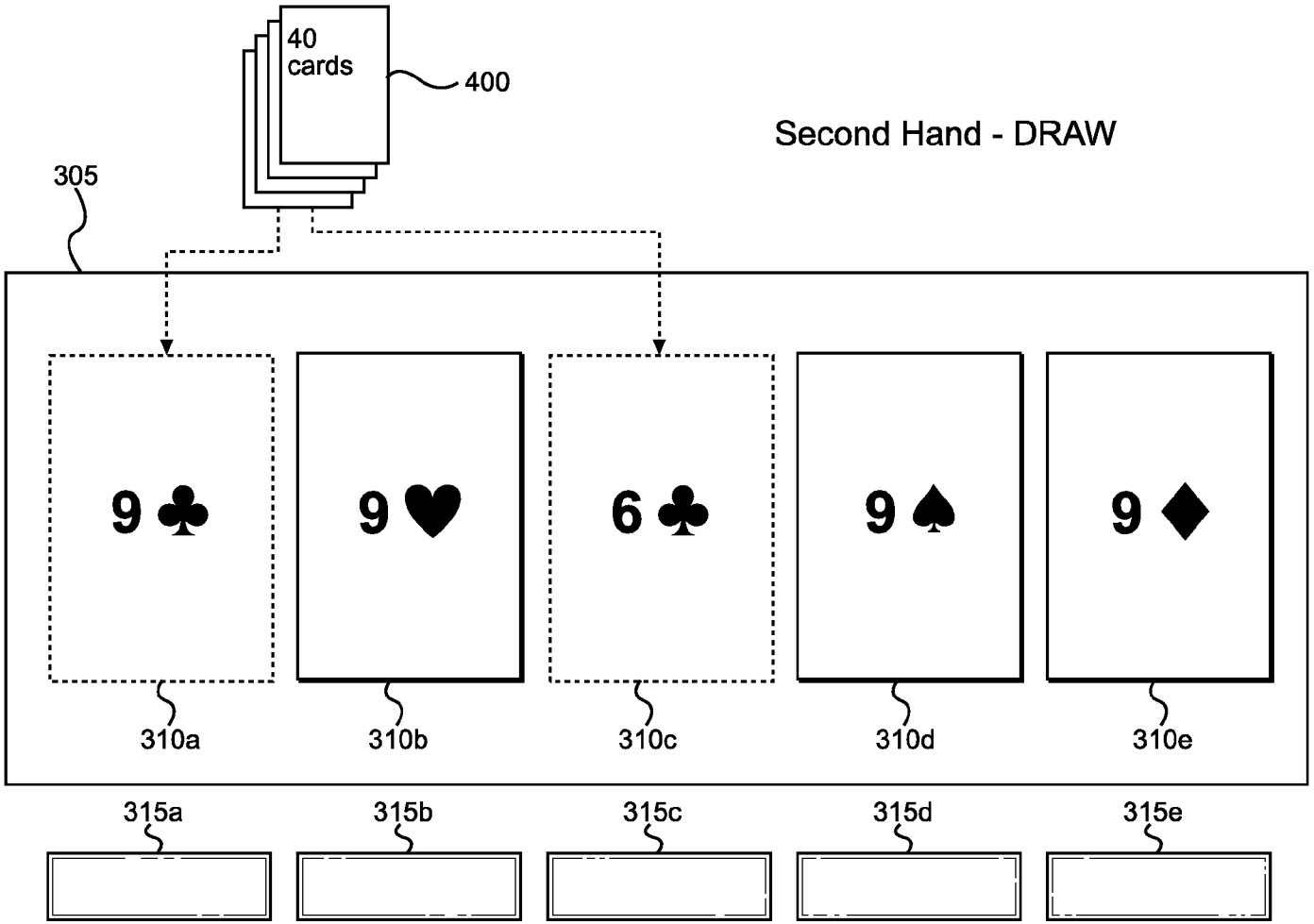

FIG. 5C is a screen shot of display 305 after the draw of the second game where new cards are substituted for the discarded cards at positions 310*a* and 310*c*, and are shown in dashed line outline form. As can be seen in FIG. 5C, two cards are drawn: the nine of clubs has replaced the king of hearts at position 310*a* and the six of clubs has replaced the four of clubs at position 310*c*. The resulting hand includes four nines which would customarily provide the player with a large payout. After the draw, the card count in deck 400 drops to 40.

Figure 5D:
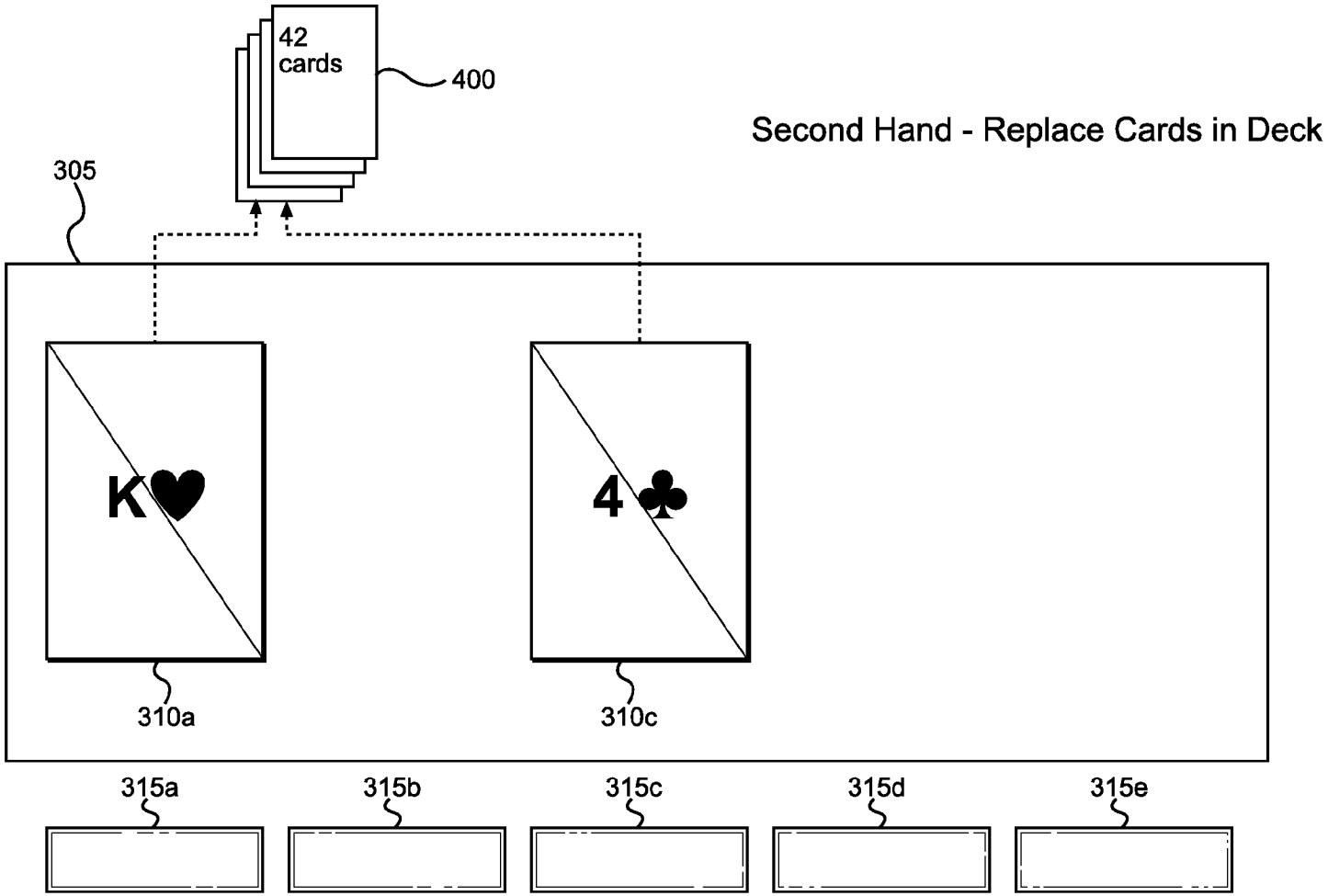

FIG. 5D is a screen shot of display 305 showing the discarded cards from the initial hand—king of hearts and four of clubs—being placed back in deck 400 upon completion of the hand so that those cards are now available to be dealt to the player in subsequent hands. For purposes of game play, the screen shot of FIG. 5D may or not be seen by the player during play. FIG. 5D is shown to provide a visual representation of the discarded cards being returned to deck 400. The card count of deck 400 increases to 42 and is now ready to be used for a third hand in the series of five games. When play of the third hand begins, a card count of 42 reflects the fact that the four nines and the six of clubs from the second hand, as well as the four aces and the three of clubs from the first hand are no longer available in deck 400.

As stated above with respect to the first hand, in an alternative embodiment, any card not used in a winning combination at the end of the game could be returned to deck 400 to be available for the next game in the series. In that case, the jack of hearts, the nine of diamonds and the three of clubs would be returned to deck 400 from the first game, and the king of hearts, the four of clubs and the six of clubs would be returned to deck 400 from the second game. All six of those cards would be available for potential replay in subsequent hands and the card count in deck 400 at the start of the third game in the series would be 46.

The series of five games would continue with play of the third, fourth and fifth hands in the same manner as described above with respect to FIGS. 4A-4D and FIGS. 5A-3D, before a player would need to decide whether to start a new series. It should be understood that to initiate play of the series, the player would make a single wager at the start of the series. The player may choose not to continue playing all games in the series, but with each game, the player has a higher probability to determine possible game results because there are fewer cards left in the deck after each game. This allows the player to optimize play strategy and increase his chances of winning with each subsequent game.

After the deal of the fifth hand, there will only by 27 cards remaining in the deck so that if the player is keeping track, he will know which cards are available to be dealt on the draw. This provides the player with the opportunity to employ new and different strategies to win each hand played.

Figure 6A:
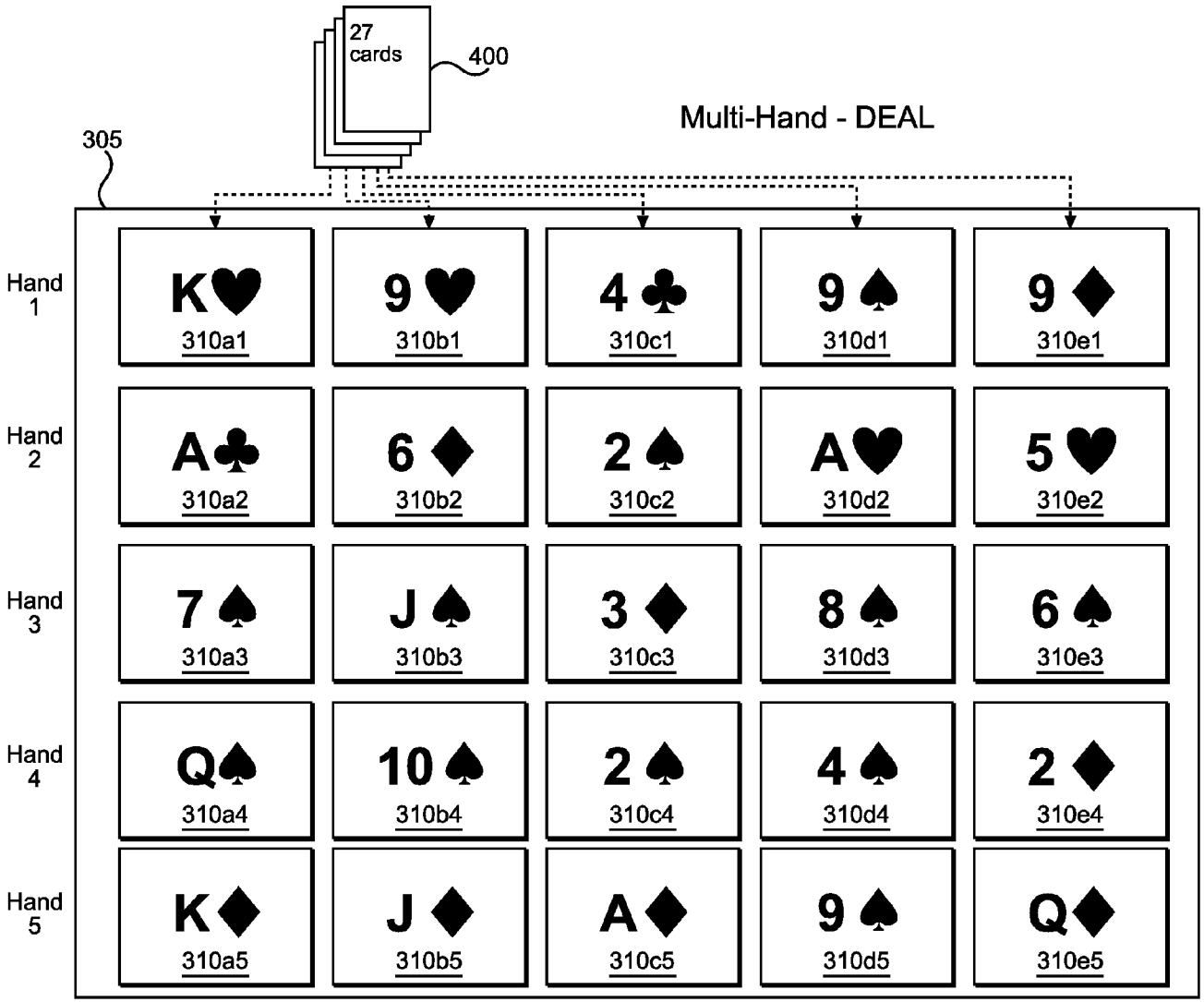
FIGS. 6A-6L are successive screen shots of a video poker machine display with game play screens illustrating the system and method according to an embodiment using a multi-hand deal.

In an alternative embodiment, the poker game may be played dealing all five hands at the outset of the sequence. FIG. 6A is a screen shot of display 305 of EGM 300 after a player has initiated game play in this embodiment. As can be seen in FIG. 6A, a set of five cards for each of five hands has been dealt to the player and each hand of cards is shown in positions 310*a-e* in five individual rows on display 305. A virtual deck 400 is shown representing the deck of cards from which the initial cards have been dealt. A card count of 27 cards is shown in deck 400 reflecting that twenty five cards have been dealt in the five hands for the series of games. Virtual deck 400 is typically a complete set of 52 cards, but may be formed of multiple decks, and also include wild cards or other special cards depending on the particular game that is being played.

As can be seen in the example shown in FIG. 6A, hand 1 dealt to the player consists of: King of Hearts at 310*a*1; 9 of Hearts at 310*b*1; 4 of Clubs at 310*c*1; 9 of spades at 310*d*1; and 9 of Diamonds at 310*e*1. Each of the other hands 2-5 is as shown in FIG. 6A. Once the hands are dealt, the player must make a decision as to which cards to hold. This may be done by touching the cards to be held on screen 305 which may be implemented as a touchscreen or through the use of a set of buttons 315. It should be recognized that a number of winning combinations may not be available in one or more of the five hands since a number of cards have already been dealt across multiple hands. For example, it is not possible to get four aces in the second hand since the Ace of Diamonds has been dealt to hand 5. It should also be recognized that provided the 10 of Diamonds is not used in a winning combination in hands 1-4, there is a relatively high probability compared to other poker games for the player to win a royal flush in hand 5. Experienced poker players employing optimum poker strategy in this case would hold the three nines at position 310*b*1, 310*d*1 and 310*e*1 in hand 1. The player holds the cards by pressing the corresponding buttons 315*a*, 315*c* and 315*e* or the cards on a touchscreen display, and then hitting a draw button (not shown) on EGM 300 for hand 1.

Figure 6B:
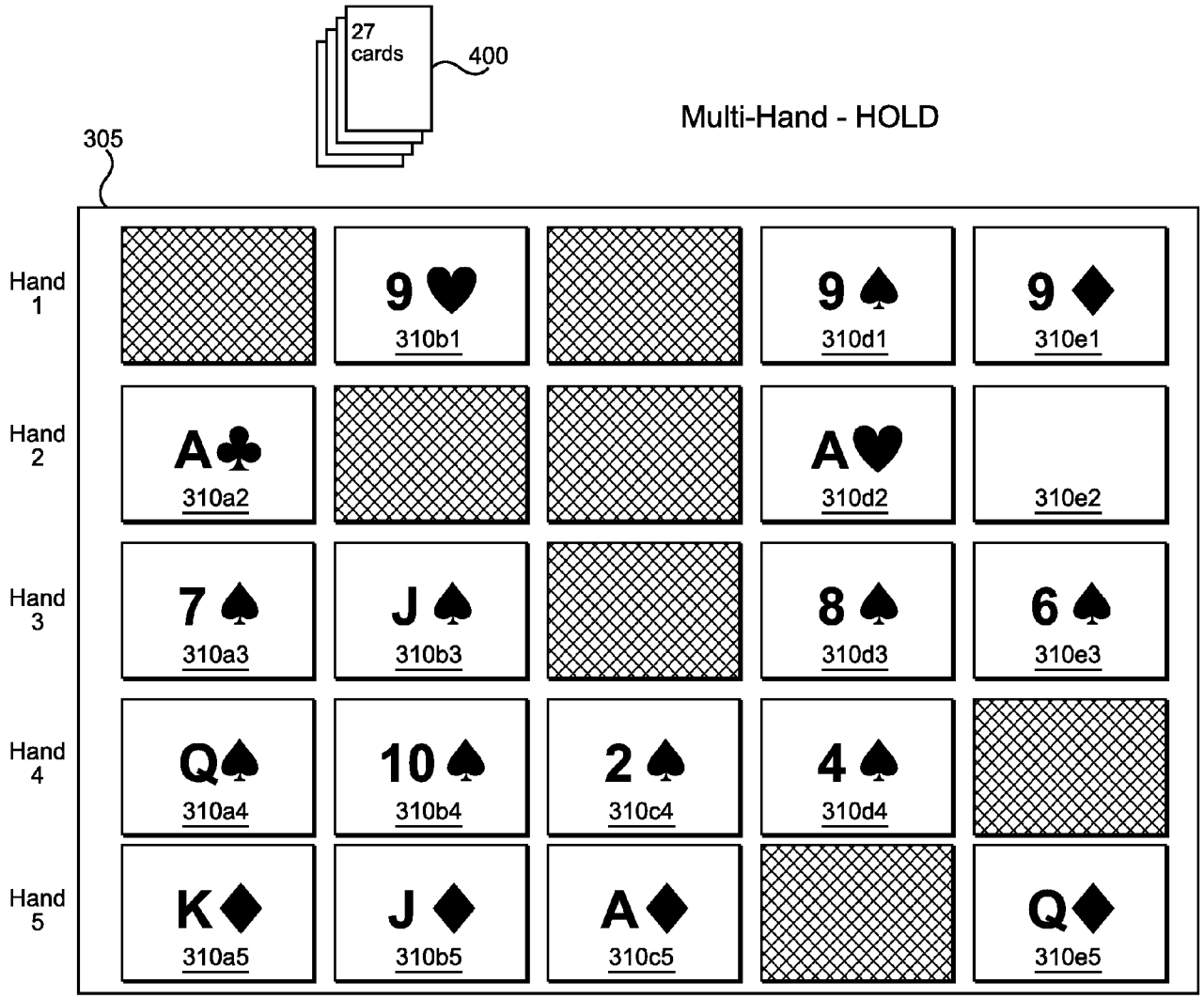

FIG. 6B is a screen shot of display 305 after the player holds the selected cards (indicated by "Hold") for hands 1-5 and hits the draw button for hand 1, but before the new cards are dealt to substitute for the cards discarded by the player from the initially dealt hand 1. The blacked out cards at positions 310*a*1 and 310*c*1 in hand 1 and the other blacked out cards represent the discarded cards from hands 1-5. The card count in deck 400 remains at 27.

Figure 6C:
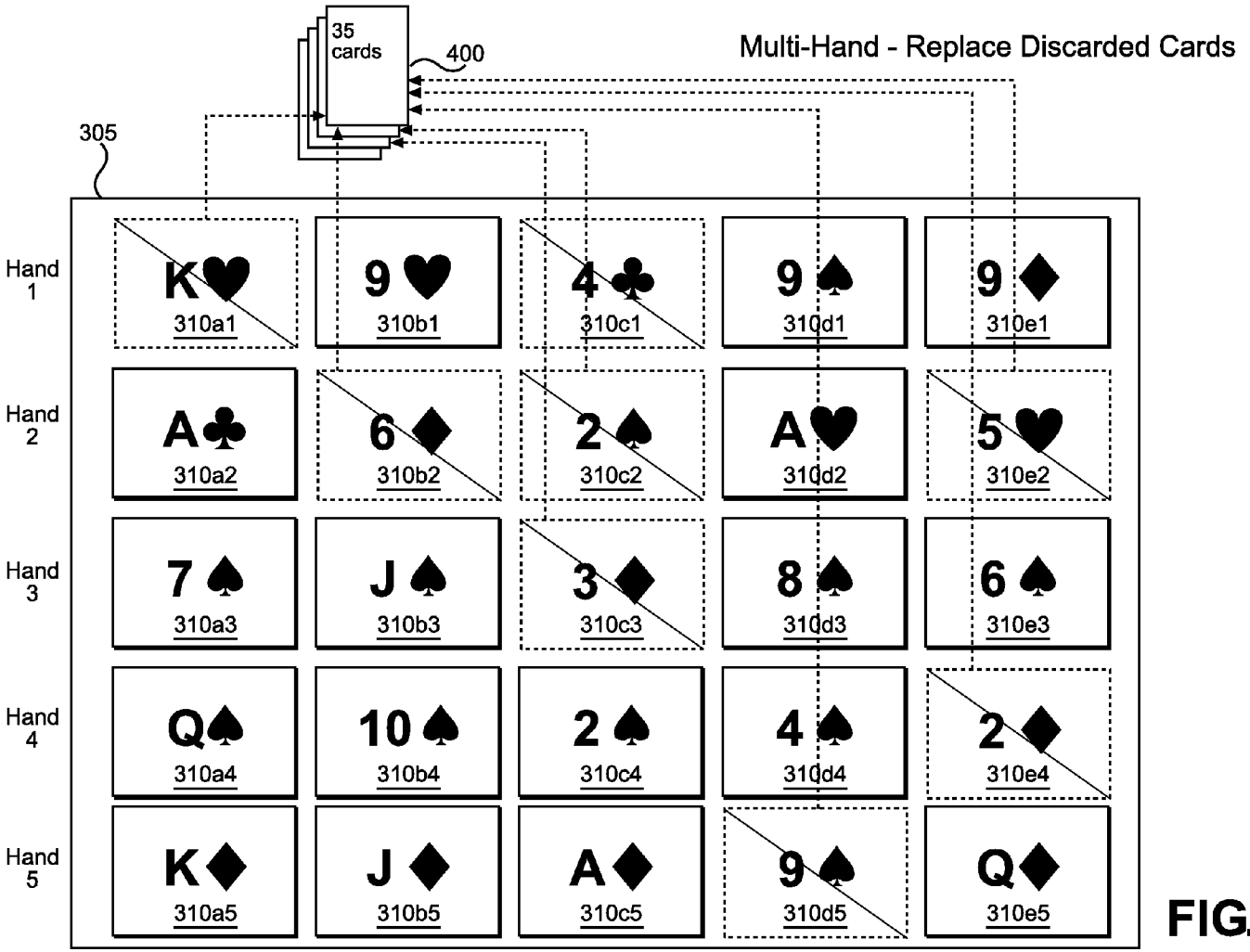

FIG. 6C is a screen shot of display 305 after the eight cards discarded from the five hands in the initial deal are returned to deck 400. These cards are as follows: a) Hand 1—King of Hearts 310*a*1 and four of Clubs 310*c*1; b) Hand 2—six of Diamonds 310*b*2, two of Spades 310*c*2 and five of Hearts 310*e*2; c) Hand 3—three of Diamonds 310*c*3; c) Hand 4—two of Diamonds 310*e*4; and e) Hand 5—nine of Spades 310*d*5. Upon return of these eight cards, deck 400 has 35 cards.

Figure 6D:
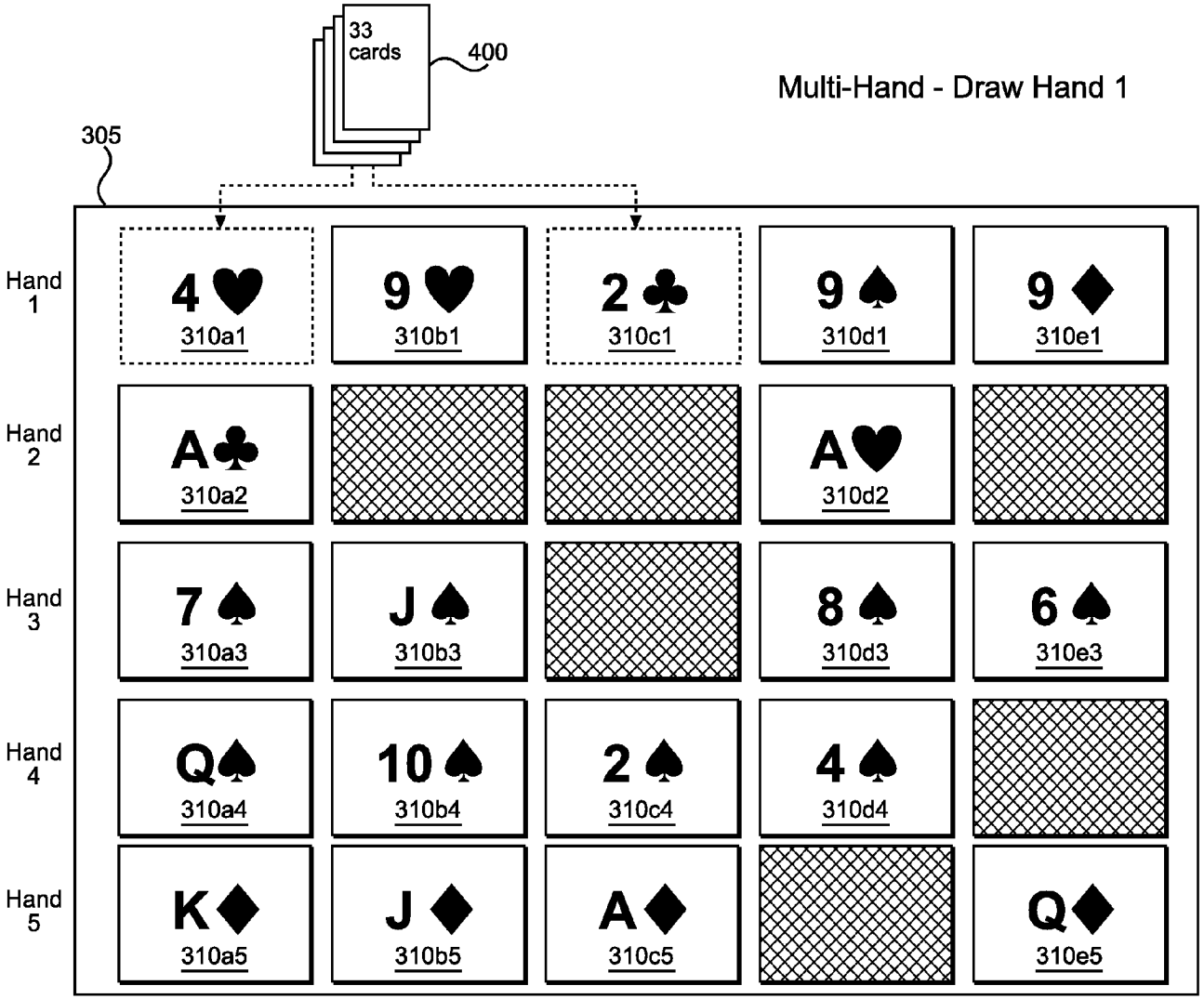

FIG. 6D is a screen shot of display 305 after the draw for hand 1 where new cards are substituted for the discarded cards at positions 310*a*1 and 310*c*1 and are shown in dashed line outline form. As can be seen in FIG. 6C, three nines were held and that is a winning combination that the player is seeking to improve by getting a fourth nine, or possibly a pair for a full house. Two cards are drawn: the four of Hearts has replaced the King of hearts at position 310*a*1 and the two of Clubs has replaced the four of Clubs at position 310*c*1. The resulting hand includes three nines which would customarily provide the player with a payout. After the draw, the card count in deck 400 drops to 33.

Figure 6E:
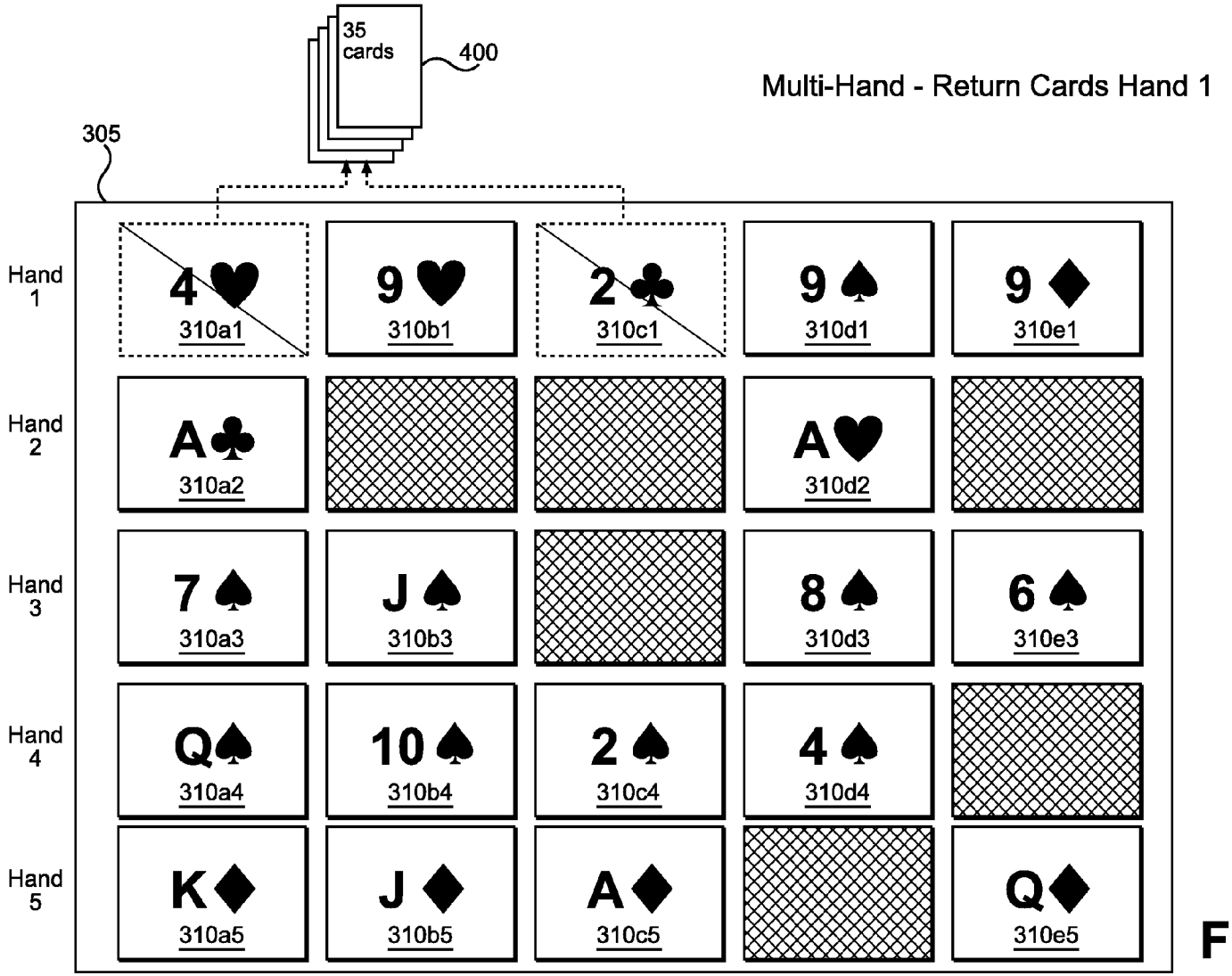

FIG. 6E is a representative screen shot of display 305 showing the cards not used in the winning combination at the completion of the game for hand 1—four of Hearts and two of Clubs—being placed back in deck 400 so that those cards are now available to be dealt to the player in subsequent hands. For purposes of game play, the screen shot of FIG. 6E may or not be seen by the player during play. FIG. 6E is shown to provide a visual representation of the discarded cards being returned to deck 400. The card count of deck 400 increases to 35 and deck 400 is now ready to be used for a second hand in the series of five games.

Figure 6F:
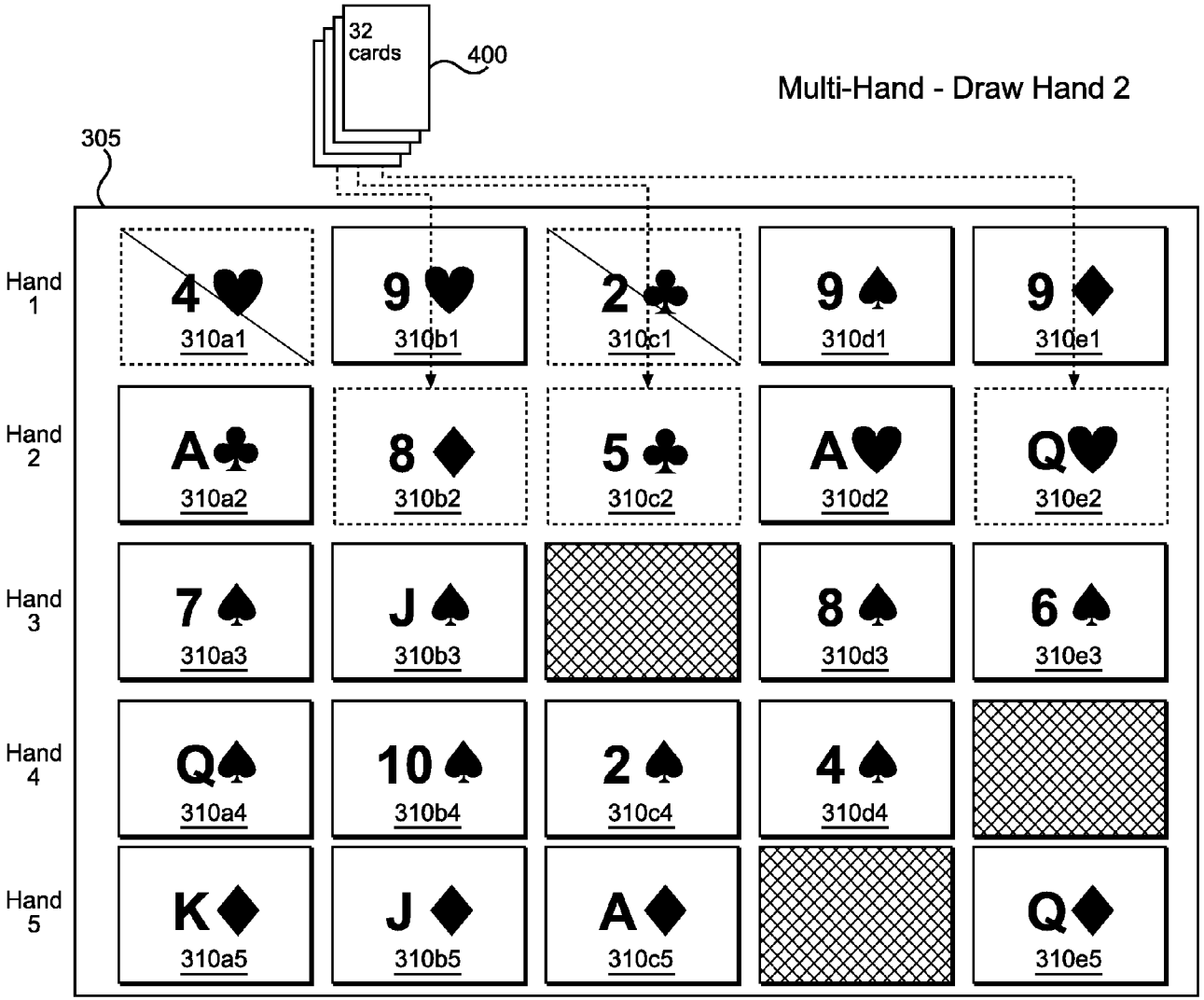

FIG. 6F is a screen shot of display 305 after the draw for hand 2 where new cards are substituted for the discarded cards at positions 310*b*2, 310*c*2 and 310*e*2, and are shown in dashed line outline form. As can be seen in FIG. 6F, three cards are drawn seeking to improve on a pair of Aces. After the draw, the eight of Diamonds has replaced the six of Diamonds at position 310*b*2, the five of Clubs has replaced the two of Spades at 310*c*2 and the Queen of Hearts has replaced the five of Hearts at position 310*e*2. The resulting hand includes two Aces which would customarily provide the player with a payout. After the draw, the card count in deck 400 drops to 32.

Figure 6G:
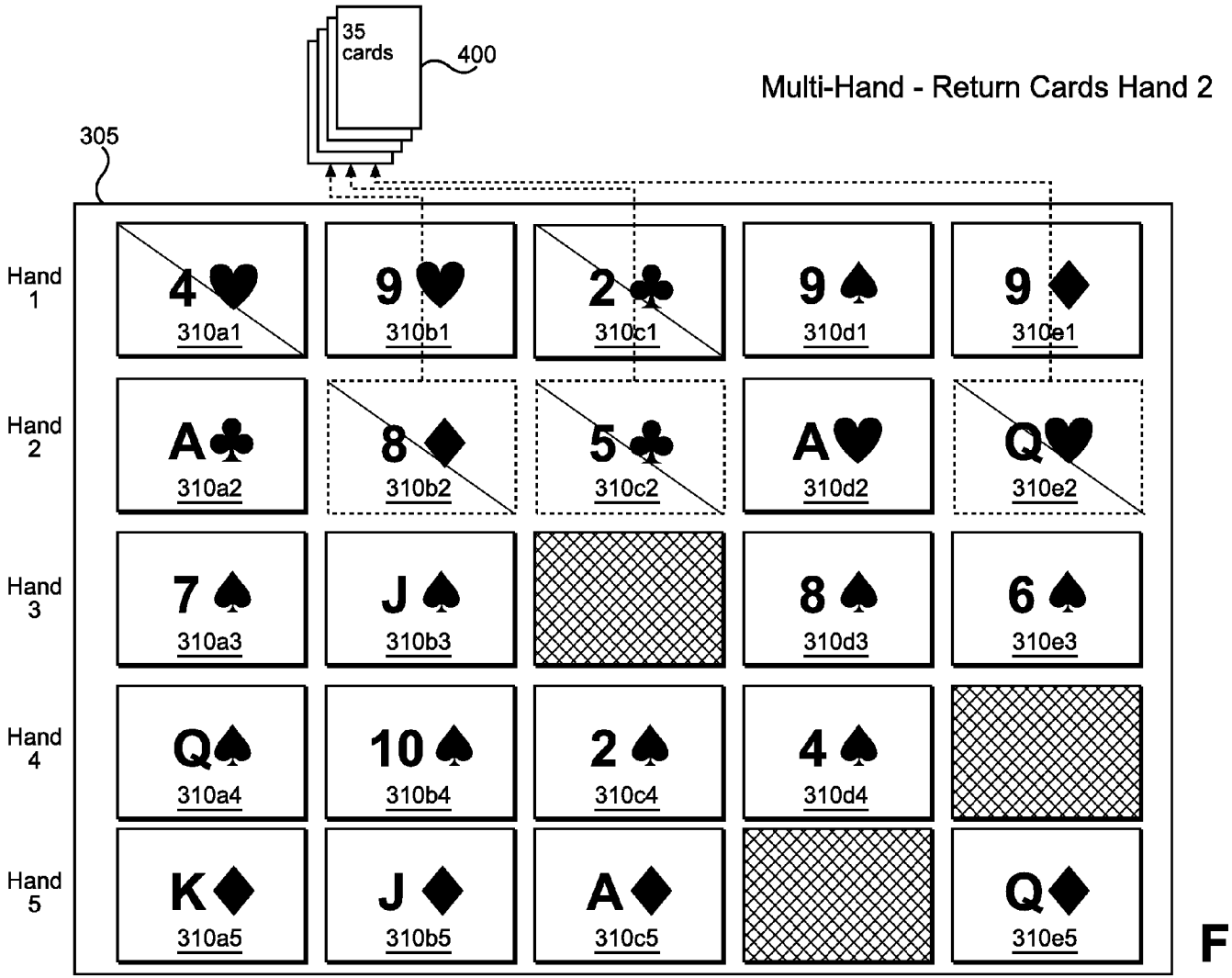

FIG. 6G is a representative screen shot of display 305 showing the cards not used in the winning combination at the completion of the game for hand 2—eight of Diamonds, five of Clubs and Queen of Hearts—being placed back in deck 400 upon completion of the hand so that those cards are now available to be dealt to the player in subsequent hands. For purposes of game play, the screen shot of FIG. 6G may or not be seen by the player during play. FIG. 6G is shown to provide a visual representation of the discarded cards being returned to deck 400. The card count of deck 400 increases to 35 and deck 400 is now ready to be used for a third hand in the series of five games.

Figure 6H:
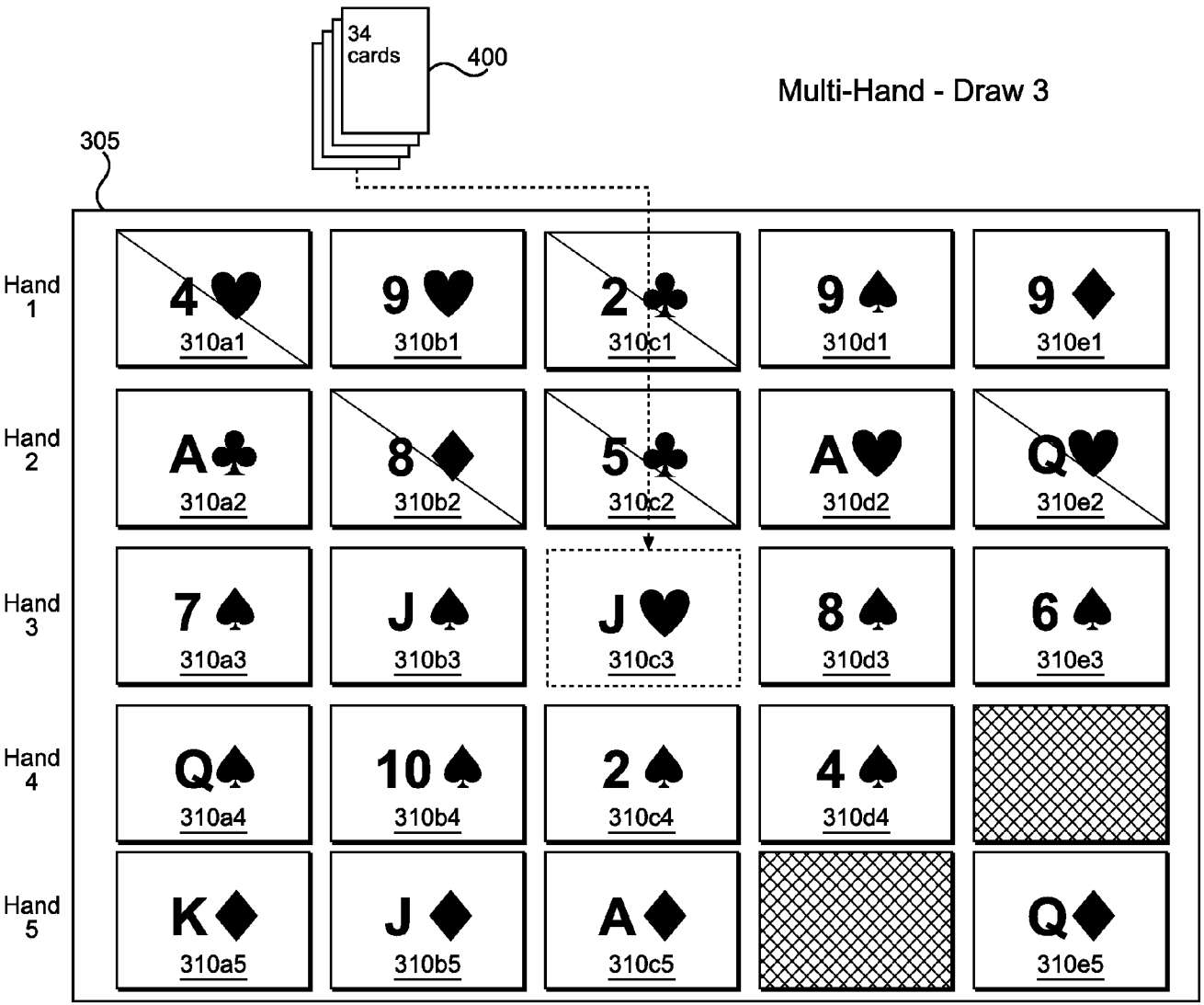

FIG. 6H is a screen shot of display 305 after the draw for hand 3 where a new card is substituted for the discarded card at position 310*c*3 and is shown in dashed line outline form and the player is seeking a Spade to achieve a flush. As can be seen in FIG. 6H, one card is drawn: the Jack of Hearts has replaced the three of Diamonds at position 310*c*3. The resulting hand is not a flush, but it includes two Jacks at 310*b*3 and 310*c*3 which is customarily a winner with a payout to the player. After the draw, the card count in deck 400 drops to 34.

Figure 6I:
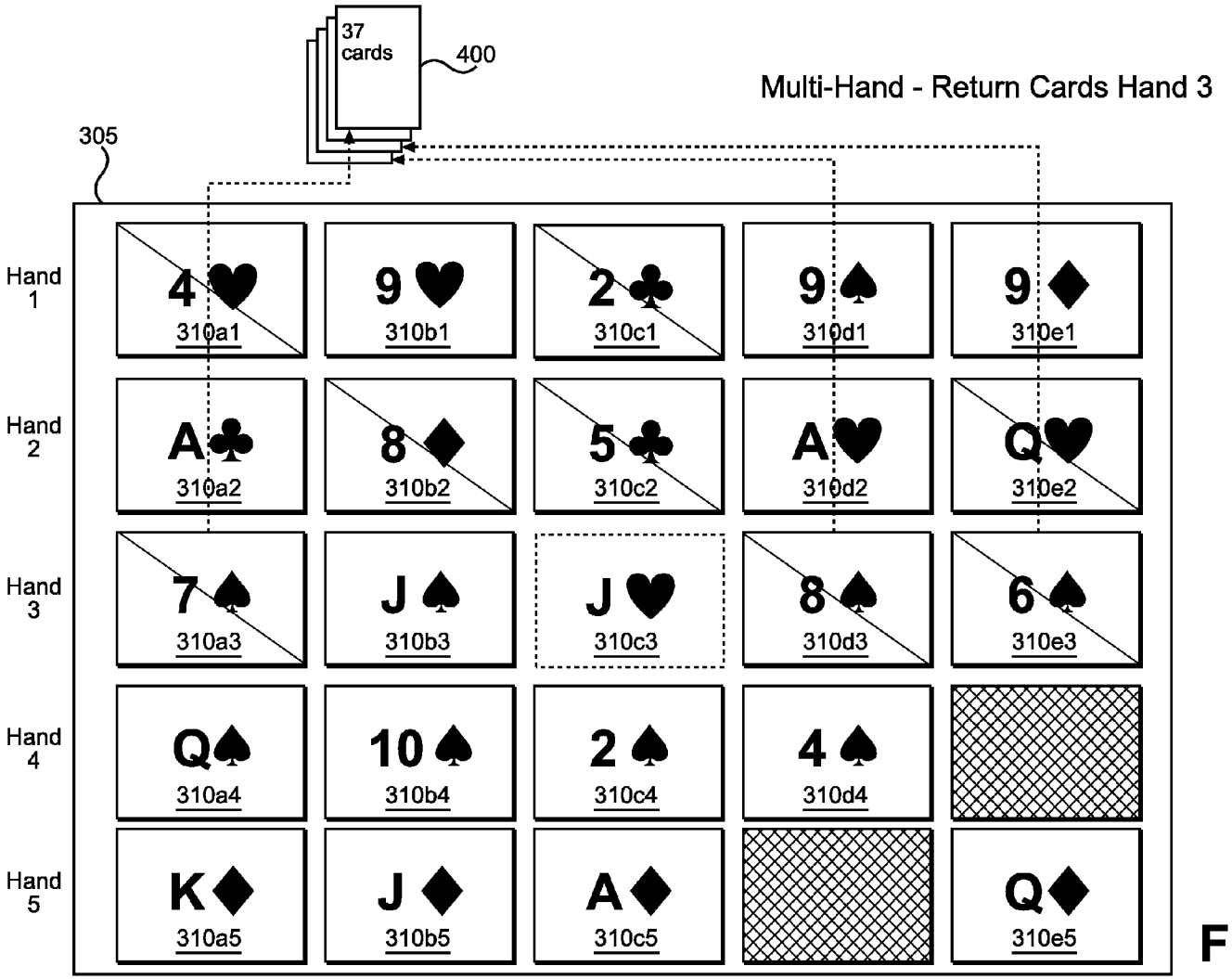

FIG. 6I is a representative screen shot of display 305 showing the cards not used in the winning combination at the completion of the game for hand 3—seven of Spades, eight of Spades and six of Spades—being placed back in deck 400 upon completion of the hand so that those cards are now available to be dealt to the player in subsequent hands. For purposes of game play, the screen shot of FIG. 6I may or not be seen by the player during play. FIG. 6I is shown to provide a visual representation of the discarded cards being returned to deck 400. The card count of deck 400 increases to 37 and deck 400 is now ready to be used for a third hand in the series of five games.

Figure 6J:
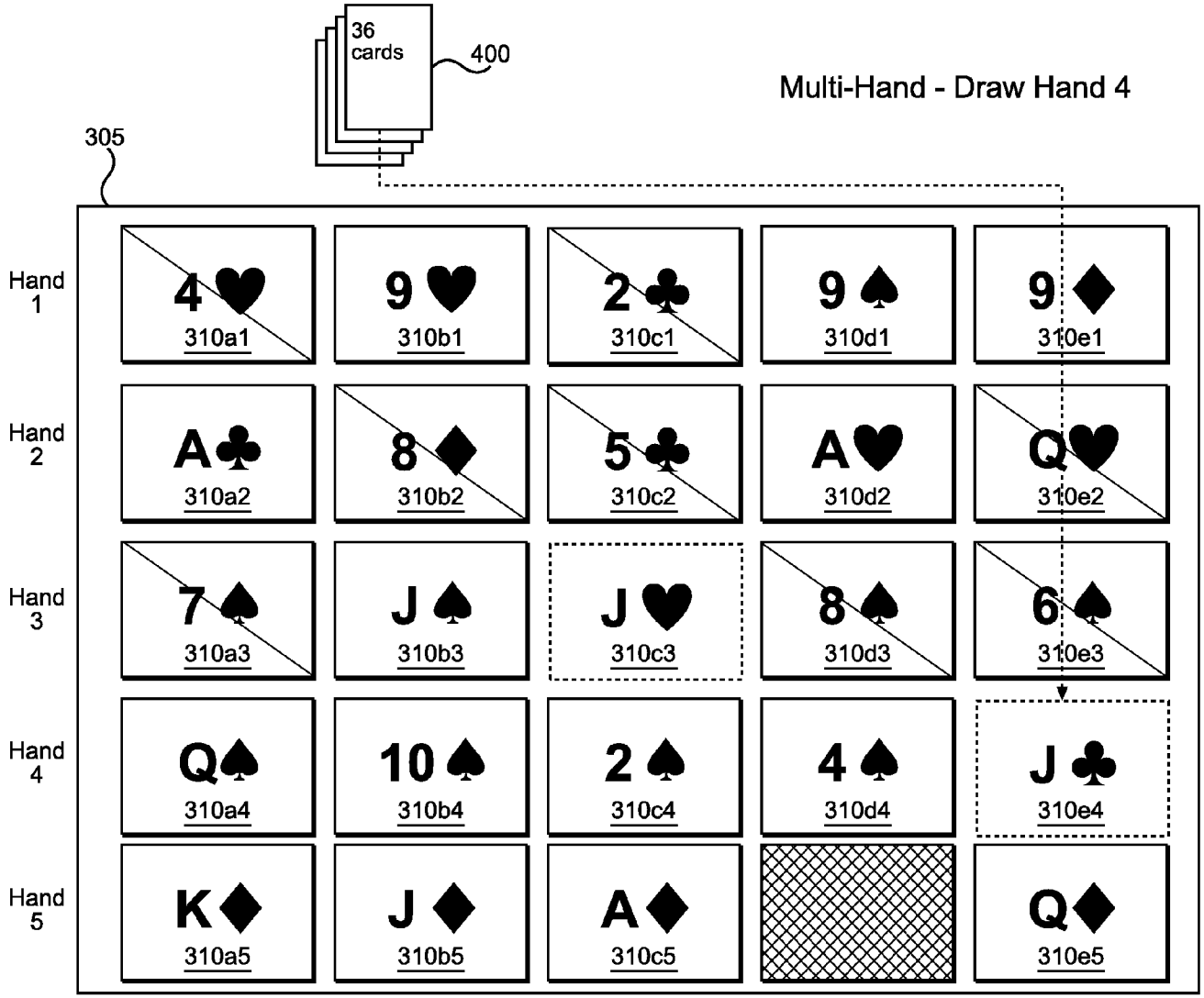

FIG. 6J is a screen shot of display 305 after the draw for hand 4 where a new card is substituted for the discarded card at position 310*e*4 and is shown in dashed line outline form. As can be seen in FIG. 6J, one card is drawn seeking a flush: the Jack of Clubs has replaced the two of Diamonds at position 310*e*4. The resulting hand includes no winning combination so there is no payout to the player and all five cards are returned to the deck. After the draw, the card count in deck 400 drops to 36.

Figure 6K:
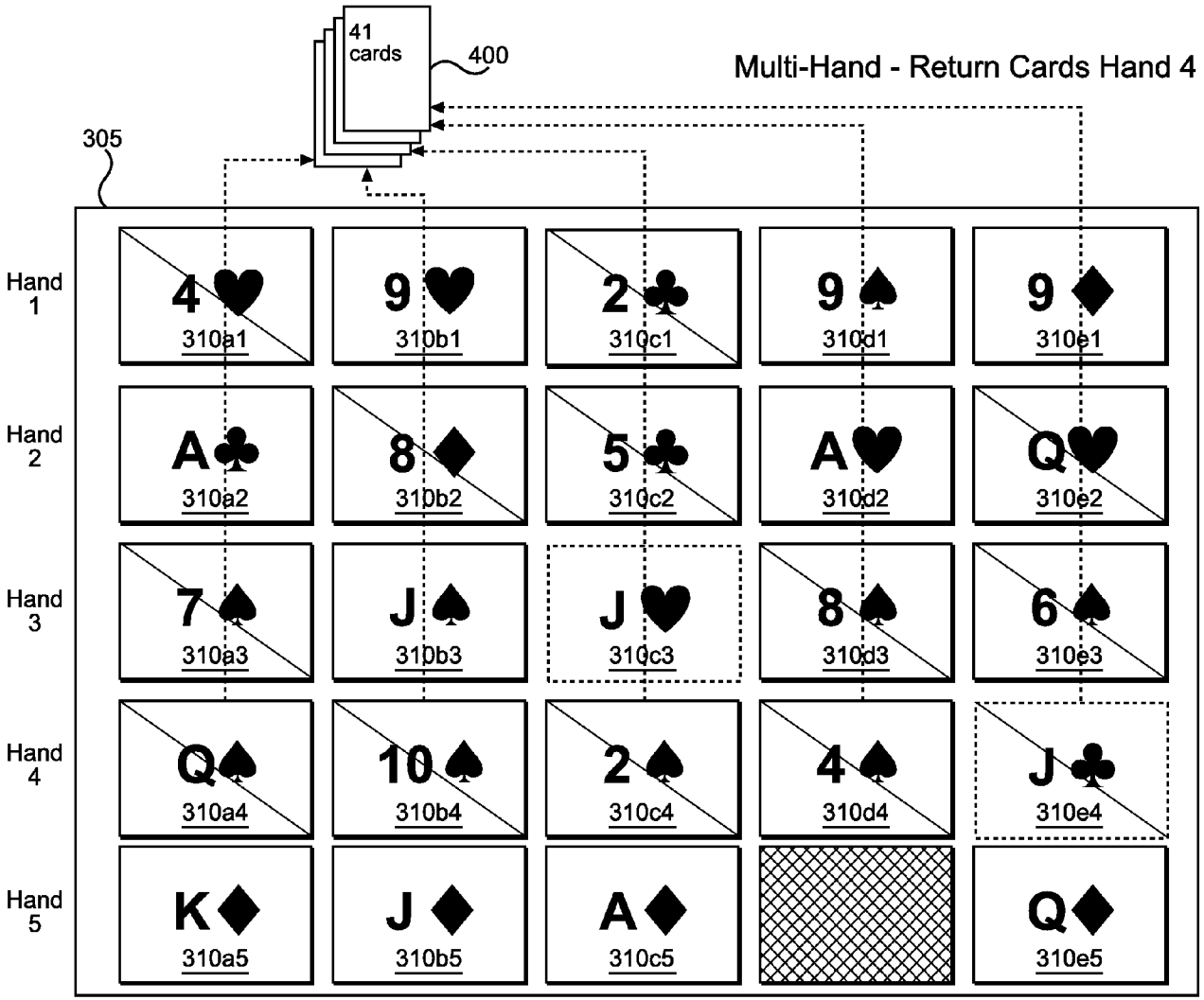

FIG. 6K is a representative screen shot of display 305 showing the cards not used in the winning combination at the completion of the game for hand 4—Queen of Spades, ten of Spades, two of Spades, four of Spades and the Jack of Clubs—being placed back in deck 400 upon completion of the hand so that those cards are now available to be dealt to the player in subsequent hands. For purposes of game play, the screen shot of FIG. 6I may or not be seen by the player during play. FIG. 6I is shown to provide a visual representation of the discarded cards being returned to deck 400. The card count of deck 400 increases to 41 and deck 400 is now ready to be used for the fifth and final hand in the series of five games.

Figure 6L:
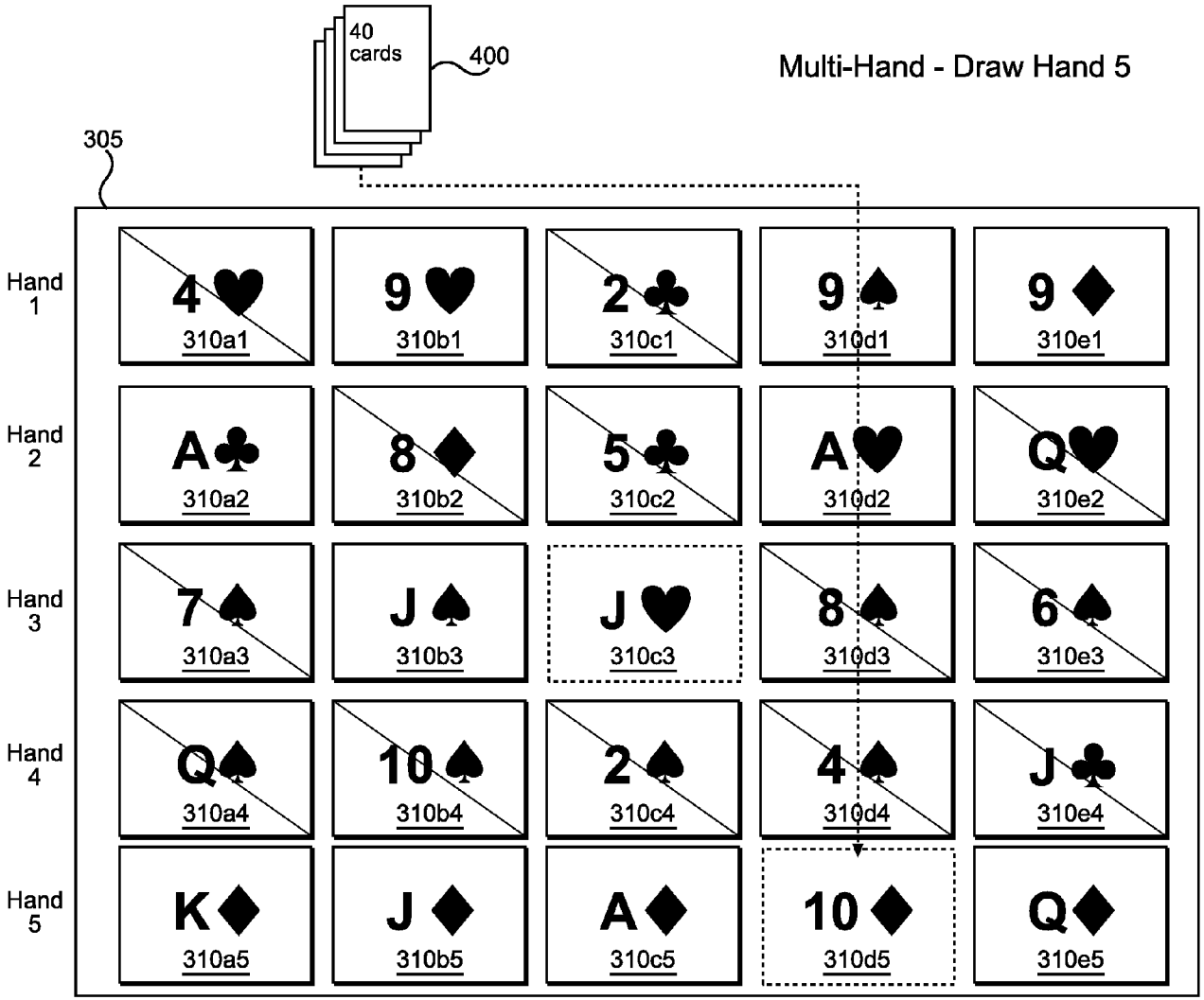

FIG. 6L is a screen shot of display 305 after the draw for hand 5 where a new card is substituted for the discarded card at position 310*d*5 and is shown in dashed line outline form where the player is seeking a royal flush. As can be seen in FIG. 6L, one card is drawn: the ten of Diamonds has replaced the nine of Spades at position 310*d*5. The resulting hand includes the ten through ace of diamonds (a royal flush) which is customarily a large winner with a payout to the player. Upon completion of the fifth hand, the player may choose to begin a new series of games.

In accordance with an alternative embodiment, any card not used in a winning combination at the end of the game could be returned to the deck for the next game in the series. In that case, in addition to the jack of hearts and the nine of diamonds, the three of clubs would also be returned to deck 400 for potential replay in subsequent hands. Deck 400 would then have 48 cards at the start of the second hand in the series.

As discussed with respect to the embodiments in FIGS. 4 and 5, it is possible that different rules for returning cards to the deck may be used. For example, instead of returning cards that are discarded from the deal and cards not used in the winning combination upon completing a hand after the draw, a game designer may choose to return only cards discarded after the deal, or only cards not used in a winning combination after the completion of a hand. Alternatively, only cards forming a winning combination at the completion of a hand may be returned to the deck. A game designer may choose any combination of cards, particular cards such as Aces or face cards, or even choose random cards to be returned to the deck.

It is to be understood that the above descriptions and drawings are only for illustrating representative variations of the present invention and are not intended to limit the scope thereof. Any variation and derivation from the above description and drawings are included in the scope of the present invention. For example, it may be required that a player place a wager in advance for all hands that are to be played in the series of hands. Alternatively, the player may be given the option of placing a wager at the dealing of cards for a subsequent hand. In addition, instead of discarded cards from the deal or cards not contributing to a winning combination at completion of a hand being returned to the deck, held cards or winning cards may be returned to the deck instead. It is also possible to take random selection of played cards to be returned to the deck, or the player may be able to choose one or more cards to be returned to the deck.

What is claimed is:

1. A method of playing two or more hands of video poker using a single deck of playing cards from which cards are distributed and into which certain cards are returned for play, the method being performed on an electronic gaming machine ("EGM") including a processor for controlling the EGM and executing a random number generator ("RNG") program, a memory for storing a control program and the RNG program, and a display, comprising:

executing the RNG program on the processor to select a random set of at least three cards from the deck to be displayed on the display and representing a first dealt poker hand;

allowing a player to select which cards from the first dealt poker hand to hold or discard;

discarding zero or more discard cards selected by the player from the first dealt poker hand and removing the discard cards from the first dealt poker hand;

executing the RNG program on the processor to select one or more draw cards to be dealt from a group of cards remaining in the deck into a first completed poker hand to replace the discarded cards on the display;

determining whether the first completed poker hand includes a winning combination; and returning zero or more played cards from one or both of the first dealt poker hand and the first completed poker hand to the deck for availability in either one or both of the draw and at least one additional hand wherein any card previously discarded and returned to the deck may not be dealt into the same hand into which it was previously dealt.

2. The method of claim 1 further comprising:

executing the RNG program on the processor to select a random set of at least three cards from a group of cards remaining in the deck to be displayed on the display and representing a second dealt poker hand;

allowing a player to select which cards from the second dealt poker hand to hold;

discarding zero or more discard cards selected by the player from the second dealt poker hand;

executing the RNG program on the processor to select one or more draw cards from the deck to be dealt into a second completed poker hand to replace the discarded cards on the display; and determining whether the second completed poker hand includes a winning combination.

3. The method of claim 1 further comprising:

accepting a wager from a player to participate in the two or more hands of video poker; and paying an award to a player if one or more completed poker hands in the two or more hands is a winner.

4. The method of claim 1 wherein the deck of cards is a single virtual deck including at least 52 standard playing cards stored in memory.

5. The method of claim 1 wherein the deck of cards is at least two virtual decks of at least 52 standard playing cards stored in memory.

6. The method of claim 1 wherein the one or more cards returned to the deck for an additional hand are selected from the following card types: a) cards discarded after the deal; b) cards that do not form part of a winning combination after completion of a hand; c) cards that are held after the deal; d) cards that are part of a winning combination after completion of a hand; e) randomly selected cards; f) predetermined cards; or g) any combination of cards in (a)-(f).

7. An apparatus for playing two or more hands of video poker using a single deck of playing cards from which cards are distributed and into which certain cards are returned for play, comprising:

at least one display;

at least one input;

a memory for storing a control program, a random number generator ("RNG") program for selecting cards to be dealt and at least one virtual deck of cards;

a processor connected to the display, the input and the memory wherein the processor runs the control program and the RNG program to conduct a session of video poker games to:

execute the RNG program on the processor to select a random set of at least three cards from the deck;

show a first dealt poker hand on the display of the at least three cards dealt from the deck;

detect a player selection on the at least one input for the first dealt poker hand with respect to cards displayed in the first dealt poker hand to either hold or discard the cards wherein any discarded card is not available to be dealt into the first dealt poker hand in a draw of additional cards;

execute the RNG program on the processor to select one or more substitute draw cards from a group of cards remaining in the deck for cards either not held or discarded and shown on the display to provide a completed first poker hand;

determine whether the completed first poker hand shown on the display is a winner; and return zero or more played cards from one or both of the first dealt poker hand and the completed first poker hand into the deck such that the returned cards are available for use in at least one additional hand.

8. The apparatus of claim 7 wherein the processor further operates the program to:

display a second dealt poker hand on the display having at least three cards dealt from a group of cards remaining in the deck of cards;

detect a player selection on the at least one input for the second dealt poker hand with respect to cards displayed in the second hand to either hold or discard the cards wherein any discarded card is not available to be dealt into the second dealt poker hand in a draw of additional cards;

execute the RNG program on the processor to select one or more draw cards from the deck;

substitute draw cards on the display from the deck for cards either not held or discarded to provide a second completed poker hand;

determine whether the second completed hand displayed on the display is a winner.

9. The apparatus of claim 7 further comprising:

a wager acceptor for accepting a wager from a player to participate in the two or more video poker hands; and an award payout component for paying an award to a player if a completed video poker hand is a winner.

10. The apparatus of claim 7 further comprising returning one or more cards to the deck for an additional hand wherein returned cards are selected from the following card types: a) cards discarded after the deal; b) cards that do not form part of a winning combination after completion of a hand; c) cards that are held after the deal; d) cards that are part of a winning combination after completion of a hand; e) randomly selected cards; f) predetermined cards; or g) any combination of cards in (a)-(f).

11. The apparatus of claim 7 further comprising a device selected from the following list: (a) an electronic gaming machine of the type used in a casino establishment; (b) a poker table game; (c) an electronic table game with a live dealer; (d) an electronic table game with a video dealer; (e) a smartphone; (f) a laptop computer; (g) a desktop computer; (h) a tablet computer; (i) a PDA, (j) a netbook computer; (i) an electronic game console; or (j) a networked terminal connected to a server.

12. A method of playing two or more hands of video poker using a single deck of playing cards from which cards are distributed and into which certain cards are returned for play, the method being performed on an electronic gaming machine ("EGM") including a processor for controlling the EGM and executing a control program and a random number generator ("RNG") program, a memory for storing the RNG program, and a display, comprising:

(a) executing the RNG program on the processor to select at least two hands of cards from a deck of cards to be shown on the display including at least three cards per hand and representing the two or more dealt poker hands on the display;

(b) allowing a player to select cards from each of the two or more dealt poker hands to hold or discard;

(c) discarding zero or more discard cards from each of the two or more dealt poker hands;

(d) executing the RNG program on the processor to select one or more draw cards from a group of cards remaining in the deck to be substituted for the discarded cards in each poker hand wherein any card previously discarded and returned to the deck may not be dealt into the same hand into which it was previously dealt;

(e) forming a completed poker hand including the draw cards;

(f) determining whether the completed poker hand includes a winning combination;

(g) returning zero or more played cards from one or more of the dealt poker hand and the completed poker hand to the deck for availability in at least one additional hand; and (h) repeating steps (b)-(f) for each additional hand in the two or more hands.

13. The method of claim 12 further comprising:

accepting a wager from a player to participate in the two or more hands of video poker; and paying an award to a player if one or more completed poker hands in the two or more hands of video poker is a winner.

14. The method of claim 12 wherein the deck of cards is a single virtual deck including at least 52 standard playing cards stored in memory.

15. The method of claim 12 wherein the deck of cards is at least two virtual decks of at least 52 standard playing cards stored in memory.

16. The method of claim 12 further comprising returning one or more cards to the deck for an additional hand wherein returned cards are selected from the following card types: a) cards discarded after the deal; b) cards that do not form part of a winning combination after completion of a hand; c) cards that are held after the deal; d) cards that are part of a winning combination after completion of a hand; e) randomly selected cards; f) predetermined cards; or g) any combination of cards in (a)-(f).

* * * * *